US007928915B2

(12) United States Patent
Sanz Arronte et al.

(10) Patent No.: US 7,928,915 B2
(45) Date of Patent: Apr. 19, 2011

(54) MULTILEVEL GROUND-PLANE FOR A MOBILE DEVICE

(75) Inventors: Alfonso Sanz Arronte, Barcelona (ES); David Gala Gala, Barcelona (ES); Antonio Condes Martinez, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 867 days.

(21) Appl. No.: 11/662,044

(22) PCT Filed: Sep. 20, 2005

(86) PCT No.: PCT/EP2005/010131

§ 371 (c)(1),
(2), (4) Date: Sep. 11, 2007

(87) PCT Pub. No.: WO2006/032455

PCT Pub. Date: Mar. 30, 2006

(65) Prior Publication Data

US 2008/0074332 A1 Mar. 27, 2008

Related U.S. Application Data

(60) Provisional application No. 60/611,889, filed on Sep. 21, 2004.

(51) Int. Cl.
*H01Q 1/24* (2006.01)

(52) U.S. Cl. ..... 343/702; 343/700 MS; 343/846; 343/849

(58) Field of Classification Search ..... 343/700 MS, 343/702, 846, 849
See application file for complete search history.

(56) References Cited

U.S. PATENT DOCUMENTS

| | | | |
|---|---|---|---|
| 3,696,438 | A | 10/1972 | Ingerson |
| 5,262,792 | A | 11/1993 | Egashira |
| 5,495,261 | A | 2/1996 | Baker et al. |
| 5,497,167 | A | 3/1996 | Luoma |
| 5,646,637 | A | 7/1997 | Miller |
| 5,703,600 | A | 12/1997 | Burrell et al. |
| 5,903,822 | A | 5/1999 | Sekine et al. |
| 6,002,367 | A | 12/1999 | Engblom et al. |
| 6,140,966 | A | 10/2000 | Pankinaho |
| 6,140,975 | A | 10/2000 | Cohen |

(Continued)

FOREIGN PATENT DOCUMENTS

CA 2416437 A1 7/2001

(Continued)

OTHER PUBLICATIONS

Puente Baliarda, C. Fractal antennas. Tesi Doctoral, PhD thesis, Universitat Politecnica de Catalunya, May 1997.

(Continued)

*Primary Examiner* — Douglas W Owens
*Assistant Examiner* — Dieu Hien T Duong
(74) *Attorney, Agent, or Firm* — Winstead PC

(57) ABSTRACT

In accordance with the teachings described herein, a multilevel ground-plane for a mobile device is provided. The multilevel ground-plane includes a first conductive surface, a second conductive surface, and a conducting strip that couples the first conducting surface to the second conducting surface. A mobile device having a multilevel ground-plane may include a printed circuit board, an antenna radiating element attached to a surface of the printed circuit board, and the multilevel ground plane integral with the printed circuit board and electromagnetically coupled to the antenna radiating element.

33 Claims, 23 Drawing Sheets

U.S. PATENT DOCUMENTS

| | | | | |
|---|---|---|---|---|
| 6,218,992 | B1 | 4/2001 | Sadler | |
| 6,271,798 | B1 | 8/2001 | Endo et al. | |
| 6,285,326 | B1 | 9/2001 | Diximus et al. | |
| 6,314,273 | B1 | 11/2001 | Matsuda | |
| 6,359,589 | B1 | 3/2002 | Bae | |
| 6,362,790 | B1 | 3/2002 | Proctor, Jr. et al. | |
| 6,366,243 | B1 | 4/2002 | Isohatala et al. | |
| 6,377,217 | B1 | 4/2002 | Zhu et al. | |
| 6,388,620 | B1 | 5/2002 | Bhattacharyya | |
| 6,400,330 | B1 | 6/2002 | Maruyama et al. | |
| 6,407,710 | B2 | 6/2002 | Keilen et al. | |
| 6,462,710 | B1 | 10/2002 | Carson | |
| 6,466,176 | B1 | 10/2002 | Maoz et al. | |
| 6,717,494 | B2 | 4/2004 | Kikuchi et al. | |
| 6,756,939 | B2 | 6/2004 | Chen et al. | |
| 6,774,866 | B2 | 8/2004 | McKinzie, III et al. | |
| 6,885,880 | B1 | 4/2005 | Ali | |
| 6,911,939 | B2 | 6/2005 | Carson et al. | |
| 2001/0033250 | A1 | 10/2001 | Keilen | |
| 2002/0177416 | A1 | 11/2002 | Boyle | |
| 2003/0193437 | A1 | 10/2003 | Kangasvieri | |
| 2004/0017318 | A1 | 1/2004 | Annabi | |
| 2004/0058723 | A1* | 3/2004 | Mikkola et al. | 455/575.7 |
| 2004/0061648 | A1 | 4/2004 | Pros et al. | |
| 2004/0217916 | A1 | 11/2004 | Quintero Illera | |
| 2004/0227678 | A1* | 11/2004 | Sievenpiper | 343/702 |
| 2004/0246187 | A1* | 12/2004 | Hara et al. | 343/702 |
| 2005/0024273 | A1* | 2/2005 | Hayes | 343/702 |
| 2007/0132658 | A1 | 6/2007 | Quintero Illera et al. | |

FOREIGN PATENT DOCUMENTS

| | | | |
|---|---|---|---|
| EP | 0519508 | A1 | 6/1992 |
| EP | 0548975 | B1 | 6/1993 |
| EP | 0688040 | A2 | 6/1995 |
| EP | 0688040 | A2 | 12/1995 |
| EP | 0892459 | A1 | 1/1999 |
| EP | 0932219 | A2 | 1/1999 |
| EP | 1026774 | A2 | 1/2000 |
| EP | 0997974 | A1 | 5/2000 |
| EP | 1148581 | A1 | 6/2000 |
| EP | 1148581 | A1 | 10/2001 |
| EP | 1211750 | A2 | 11/2001 |
| EP | 1 401 050 | | 3/2004 |
| EP | 1401050 | A1 | 3/2004 |
| EP | 1 441 412 | | 7/2004 |
| EP | 1441412 | A1 | 7/2004 |
| JP | 1022723 | | 1/1989 |
| JP | 1032422 | | 2/1989 |
| JP | 10261914 | | 9/1998 |
| JP | 200512516 | | 1/2005 |
| WO | 9627219 | A1 | 9/1996 |
| WO | 97/06578 | A1 | 2/1997 |
| WO | 9908337 | A1 | 2/1999 |
| WO | 00/30211 | A1 | 5/2000 |
| WO | 00/52784 | A1 | 9/2000 |
| WO | 01/22528 | A1 | 3/2001 |
| WO | 0139321 | A1 | 5/2001 |
| WO | 01/54225 | A1 | 7/2001 |
| WO | 0180354 | A1 | 10/2001 |
| WO | 01/89031 | A1 | 11/2001 |
| WO | 0229929 | A2 | 4/2002 |
| WO | 02095869 | A1 | 11/2002 |
| WO | 03023900 | A1 | 3/2003 |
| WO | WO-03/023900 | | 3/2003 |
| WO | 03034544 | A1 | 4/2003 |
| WO | 03096475 | A1 | 11/2003 |
| WO | 2004001894 | A1 | 12/2003 |
| WO | WO-2004/001894 | | 12/2003 |
| WO | 2004013933 | A1 | 2/2004 |
| WO | 2006/031170 | A1 | 3/2006 |
| WO | 2006051113 | A1 | 5/2006 |
| WO | 2006070017 | A1 | 7/2006 |
| WO | 2007028448 | A1 | 3/2007 |
| WO | 2007039071 | A2 | 4/2007 |

OTHER PUBLICATIONS

Moretti, P. Numerical investigation of vertical contacless transitions for multilayer RF circuits, Microwave Symposium Digest, 2001 IEEE MTT-S International, 2001.

Soler, J. et al. Multifrequency properties of monopole antennas using multilevel ground planes inspired on the Sierpinski Fractal Shape, Fractus S.A., Jun. 2003.

Ghorbani, K. et al. Dual polarized wide-band aperture stacked patch antennas, IEEE Antennas and Propagation, Aug. 2004, vol. 52, No. 8.

Hossa, R et al., "Improvement of Compact Terminal Antenna Performance by Incorporating Open-End Slots in Ground Plane", IEEE Microwave and Wireless Components Letters, vol. 14, No. 6, Jun. 2004.

Manteuffel, Dirk et al., "Investigation on Integrated Antennas for GSM Mobile Phones", Millennium Conference on Antennas & Propagation, Apr. 2000.

Elamaran, A beam-steerer using reconfigurable PGB ground plane, IEEE. MTT-S Int. Microwave Symp. Dig, 2000.

Kim, A novel photonic bandgap structure for low-pass filter of wide stop band, IEEE Microwave and Guided Wave Letters, Jan. 2000, vol. 10, n. 2.

Gschwendtner, Multi-service dual-mode spiral antenna for conformal integration into vehicle roofs, IEEE Antennas and Propagation Society International Symposium, 2000.

Huang, Dielectric resonator antenna on a slotted ground plane, IEEE Antennas and Propagation Society International Symposium and USCN/URSI National Radio Science Meeting, 2001.

Wern, Designs of compact microstrip antennas with a slotted ground plane, IEEE Antennas and Propagation Society International Symposium, 2001.

Horii, Harmonic control by photonic bandgap on microstrip patch antenna, IEEE Microwave and Guided Wave Letters, 1999, vol. 9 No. 1.

Wong, Improved microstrip Sierpinsli carpet antenna, IEEE Proceedings of APMC, 2001.

Lin, A dual-frequency microstrip-line-fed printed slot antenna, Microwave and Optical Technology Letters, Mar. 20, 2001, vol. 26, No. 6.

Huynh, Ground planes effects on PIFA performance, IEEE APS/URSI Conference, Jul. 2000.

Volski, Influence of the shape of the ground plane on the radiation parameters of planar antennas, Proc. of the Millenium AP conference, Apr. 2000.

Natarajan, Effect of ground plane shaoe on microstrip antenna performance for cell phone applications, IEEE Antennas and Propagation Society International Symposium, 200, vol. 3.

Chiou et al. Designs of compact microstrip antennas with a slotted ground plane, IEEE Antennas and propagation society international symposium, 2001.

Anguera et al. Enhancing the performance of handset antennas by means of groundplane design, IWAT, 2006.

Huang et al. Cross-slot-coupled microstrip antenna and dielectric resonator antenna for circular polarization, IEEE Transactions on Antennas and Propagation, 1999, vol. 47, No. 4.

Lau et al. A novel wideband circularly polarized patch antenna based on L-Probe and slot-coupling techniques, Antennas and Propagation Society International Symposium, 2003.

Lim et al. RF-system-on-package (SOP) for wireless communications, IEEE Microwave Magazine, Mar. 2002.

Denidni et al. Design of single layer broadband slot antennas, Electronic Letters, 2004, vol. 40, No. 8.

Soler et al. Multifrequency properties of monopole antennas using multilevel ground planes inspired on the Sierpinski fractal shape.

Huang, Slotted ground plane for frequency tunable dielectric resonator antenna, Microwave and Optical Technology Letters, 2002, vol. 35, No. 3.

Wong, Compact and broadband microstrip antenna, Wiley-Interscience, 2002.

Gong, Compact planar inverted-F antenna with a PGB-Type ground plane for mobile communications, IEEE Transactions on Vehicular, 2003, vol. 52, No. 3.

Hossa, Improvement of compact terminal antenna performance by incorporating open-end slots in ground plane, IEEE Microwave and Wireless Components Letters, 2004, vol. 14, No. 6.
Ke, Broadband proximity-coupled microstrip antennas with an H-shaped slot in the ground plane, IEEE Antennas and Propagation Society International Symposium, 2002.
Kyriacou, A design procedure for aperture coupled microstrip antennas based on approximate equivalent networks, Microwave and Optical Technology Letters, 2002.
Kabacik, P. et al, Broadening the bandwidth in terminal antennas by tuning the coupling between the element and its ground, IEEE Antennas and Propagation Society International Symposium, Jul. 3, 2005.
Ferrero, Dual-band circularly polarized microstrip antenna for satellite applications, IEEE Antennas and Wireless Propagation Letters, 2005, vol. 4.
Sangin et al. investigations of near field and performance degradation due to objects in the vicinity of radiating elements, [Master of Science Thesis], Ericsson Mobile Communications AB, Apr. 2005.
Wong, Planar antennas for wireless communications, Wiley-InterScience, 2003.
Abedin et al. Modifying the ground plane and its effect on planar inverted-F antennas (PIFAs) for mobile phone handsets, IEEE Antennas and Wireless Propagation Letters, 2003, vol. 2.
Shafai, Lotfollah L. et al, Dual-band dual-polarized perforated microstrip antennas for SAR applications, IEEE Transactions on Antennas and Propagation, Jan. 2000, vol. 48, No. 1.
Karaboikis, Compact dual-printed inverted-F antenna diversity systems for portable wireless devices, IEEE antennas and Wireless Propagation Letters, 2004, vol. 3.

* cited by examiner

MULTILEVEL GROUND-PLANE FOR A MOBILE DEVICE

This patent application claims the benefit of priority from U.S. Provisional Patent Application Ser. No. 60/611,889 filed on Sep. 21, 2004. This application incorporates by reference the entire disclosure of U.S. Provisional Patent Application Ser. No. 60/611,889.

FIELD

The technology described in this patent document relates generally to antennas. More specifically, this document describes antenna ground-planes having multilevel structures, which are particularly well-suited for use as the ground-plane in miniature and multiband antennas in a mobile device, such as a cellular telephone.

BACKGROUND

In many antenna applications, such as mobile devices (e.g., cellular telephones, PDAs, pagers, etc.), the size of the device may restrict the size of the antenna and its ground-plane, which may effect the overall antenna performance. For example, the bandwidth and efficiency of the antenna may be affected by the overall size, geometry, and dimensions of the antenna and the ground-plane. A report on the influence of the ground-plane size in the bandwidth of terminal antennas can be found in the publication "*Investigation on Integrated Antennas for GSM Mobile Phones*", by D. Manteuffel, A. Bahr, I. Wolff, *Millennium Conference on Antennas & Propagation, ESA, AP*2000, Davos, Switzerland, April 2000.

SUMMARY OF THE INVENTION

In accordance with the teachings described herein, a multilevel ground-plane for a mobile device is provided. The multilevel ground-plane includes a first conductive surface, a second conductive surface, and a conducting strip that couples the first conducting surface to the second conducting surface. A mobile device having a multilevel ground-plane may include a printed circuit board, an antenna radiating element attached to a surface of the printed circuit board, and the multilevel ground plane integral with the printed circuit board and electromagnetically coupled to the antenna radiating element.

Another aspect of the invention refers to an antenna system or an antenna device, which comprises a radiating element placed over a ground plane, wherein the radiating element has at least one edge and the ground plane has at least one slot, so that at least a part of one edge of the radiating element is positioned over a part of one slot of the ground plane. This particular arrangement of the radiating element and the ground plane, improve the performance of the antenna.

A further aspect of the invention, refers to a radiating element or an antenna which comprises at least one hole defining an empty area on said radiating element, wherein the shape of said empty area is formed by polygonal shapes connected or overlapping at a contact region of their perimeter, wherein the contact region between directly connected polygonal shapes is narrower than 50% of the perimeter of said polygonal shapes, and wherein the polygonal shapes have the same number of sides but not all the polygonal shapes have the same shape. This radiating element or antenna, may be used in the above described antenna system.

A further aspect of the invention refers to a mobile communications device which comprises the above described antenna system. The communication device may consist for instance in a cellular telephone, a PDA, or a pager.

BRIEF DESCRIPTION OF THE DRAWINGS

FIG. 3.—illustrate examples of planar inverted-F antenna (PIFA) structures.

FIG. 4.—illustrate examples of monopole antenna structures.

FIG. 5.—illustrate another example antenna configuration.

DETAILED DESCRIPTION

Multilevel ground-planes, as described herein, are an integral part of the antenna structure, and contribute to the radiation and impedance performance of the antenna (e.g., impedance level, resonant frequency, bandwidth.) That is, the antenna ground-plane is shaped to force the ground-plane currents to flow and radiate in such a way that the combined effect of the ground-plane and the radiating element enhances the performance and characteristics of the whole antenna device (e.g., bandwidth, VSWR, multiband behaviour, efficiency, size, gain.) This is achieved by breaking the solid surface of the antenna ground-plane into a plurality of conducting surfaces that are electromagnetically coupled by the capacitive effect between the edges of the several conducting surfaces, by a direct electrical contact through one or more conducting strips, or by a combination of both. This ground-plane structure may be formed by including a multilevel geometry in at least a portion of the ground-plane. In addition, the multilevel ground-plane geometry may include one or more space-filling curves, as described below.

For the purposes of this patent document, a multilevel ground-plane geometry includes a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting ground-plane. In this definition of multilevel geometry, circles and ellipses are included because they can be understood as polygons with an infinite number of sides.

Figure 1:
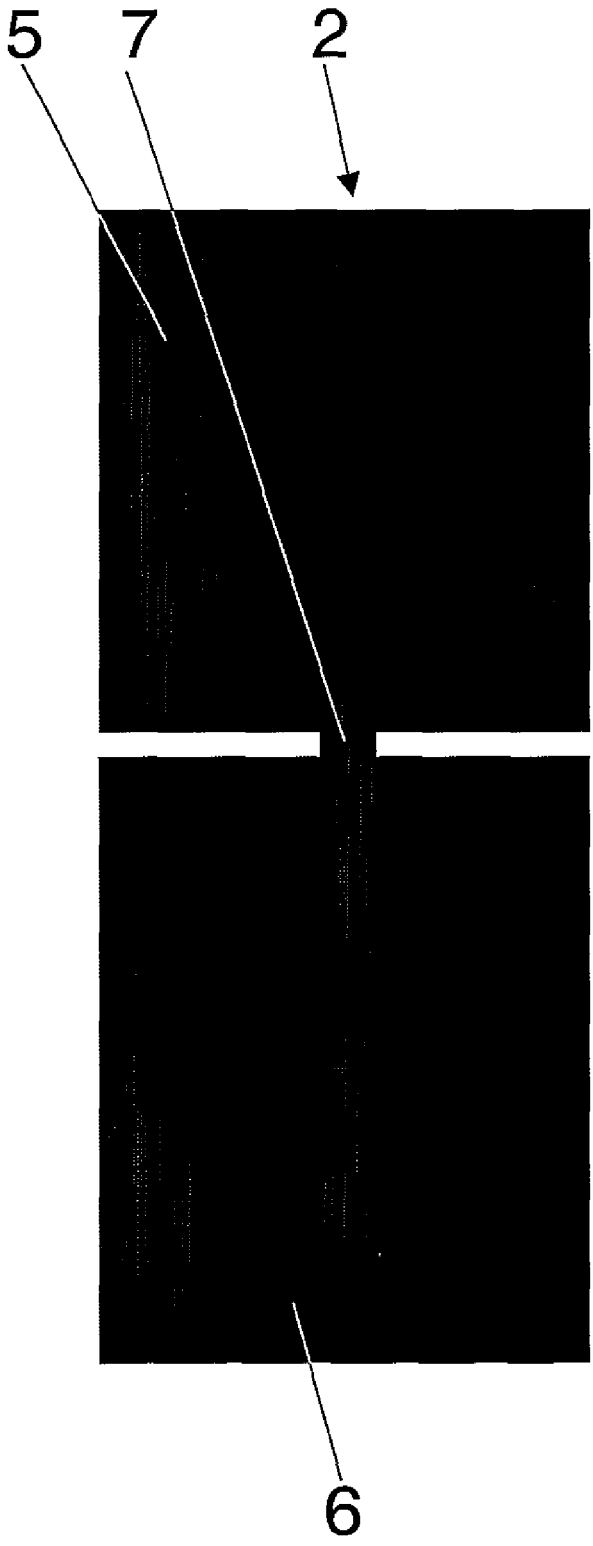
FIG. 1.—shows an example multilevel ground-plane for an antenna.

FIG. 1 shows an example multilevel ground-plane (2) for an antenna. The ground plane includes two conducting surfaces (5), (6) that are electrically connected by a conducting strip (7). The conducting surfaces (5), (6), in this example are electromagnetically coupled by the capacitive effect between adjacent edges and also by direct electrical contact through the conducting strip (7).

Figure 2:
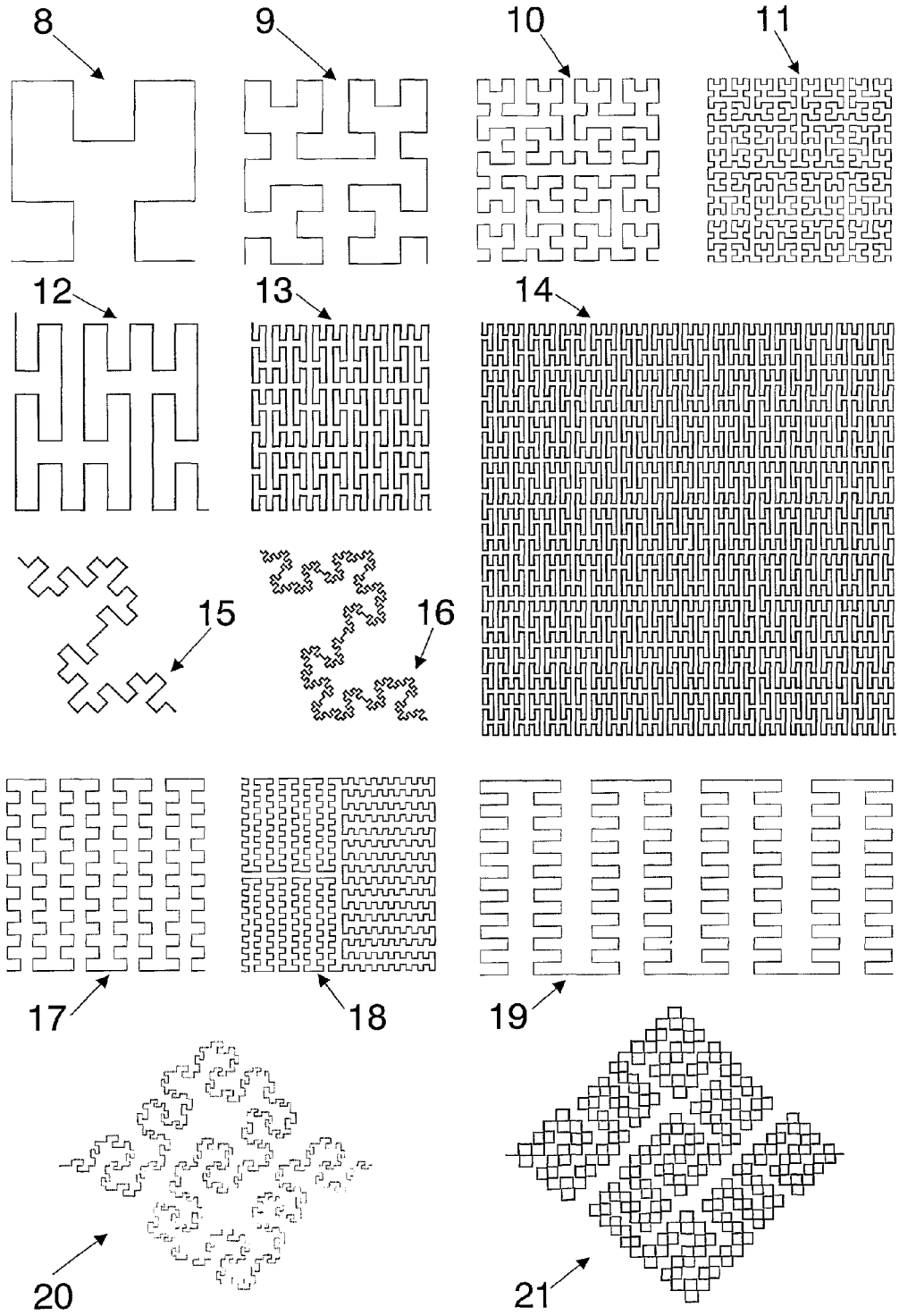
FIG. 2.—illustrates a number of example space-filling curves that may be included in a multilevel ground-plane.

FIG. 2 illustrates a number of example space-filling curves (8-21) that may be included in a multilevel ground-plane. A space-filling curve (hereafter SFC) is a curve that is large in terms of physical length but small in terms of the area in which the curve can be included. More precisely, the following definition is taken in this document for a space-filling curve: a curve composed by at least ten segments which are connected in such a way that each segment forms an angle with adjacent segments, that is, no pair of adjacent segments define a larger straight segment, and wherein the curve can be optionally periodic along a fixed straight direction of space if, and only if, the period is defined by a non-periodic curve that includes at least ten connected segments and no pair of said adjacent and connected segments defines a straight longer segment. Also, the SFC can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the ground-plane, the segments of the SFC curves included in said ground-plane should be shorter than a tenth of the free-space operating wavelength.

Depending on the shaping procedure and curve geometry, some infinite length SFC can be theoretically designed to feature a Haussdorf dimension larger than their topological-dimension. That is, in terms of the classical Euclidean geometry, it is usually understood that a curve is always a one-dimension object; however when the curve is highly convoluted and its physical length is very large, the curve tends to fill parts of the surface which supports it; in that case, the Haussdorf dimension can be computed over the curve (or at least an approximation of it by means of the box-counting algorithm) resulting in a number larger than unity. The curves described in FIG. 2 are some examples of such SFC; in particular, drawings 11, 13, 14, and 18 show some examples of SFC curves that approach an ideal infinite curve featuring a dimension D=2. As known by those skilled in the art, the box-counting dimension can be computed as the slope of the straight portion of a log-log graph, wherein such a straight portion is substantially defined as a straight segment. In this case, said straight segment should cover at least an octave of scales on the horizontal axis of the log-log graph.

Referring again to FIG. 2, an initial SFC (8) is illustrated, from which other SFCs (9), (10), (11) may be formed (called Hilbert curves.). Likewise, other sets of SFCs may be formed from different initial SFCs, such as SFC set (12), (13) and (14) (called SZ curves), SFC set (15) and (16) (called ZZ curves), SFC set (17), (18) and (19) (called HilbertZZ curves), SFC (20) (Peanodec curve), and SFC (21) (based on the Giusepe Peano curve.)

Figure 3A:
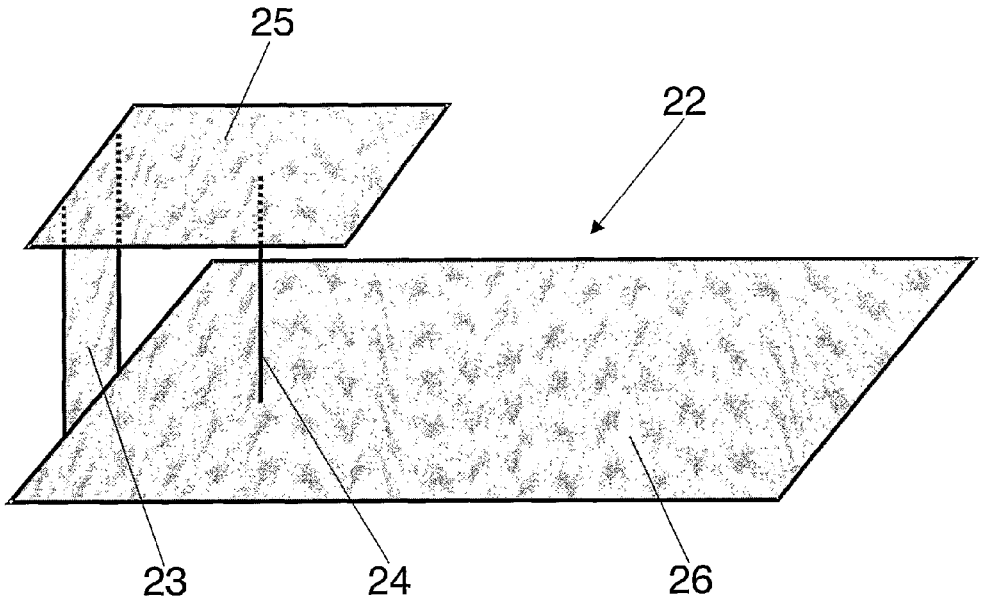
FIG.3A (Prior Art)
FIG. 3A is an example of the prior art.
Figure 3B:
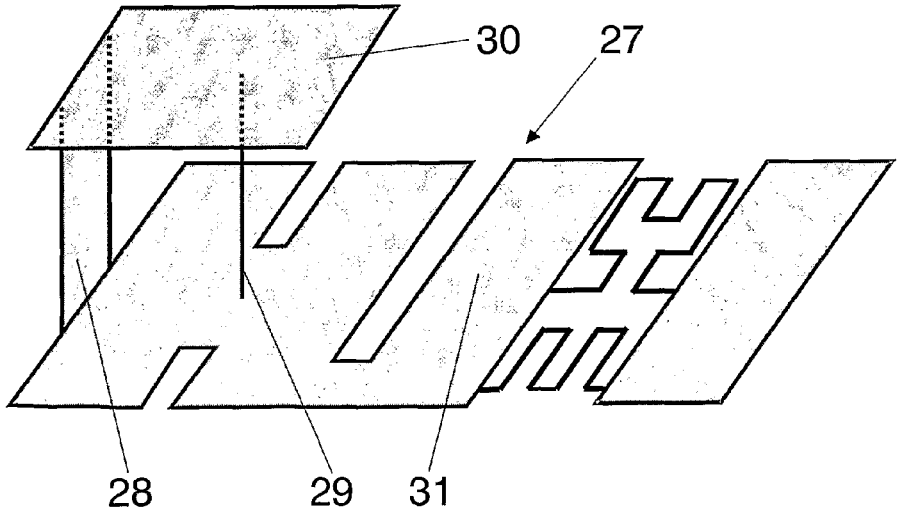
FIG. 3B is an example according to the present invention.
Figure 4A:
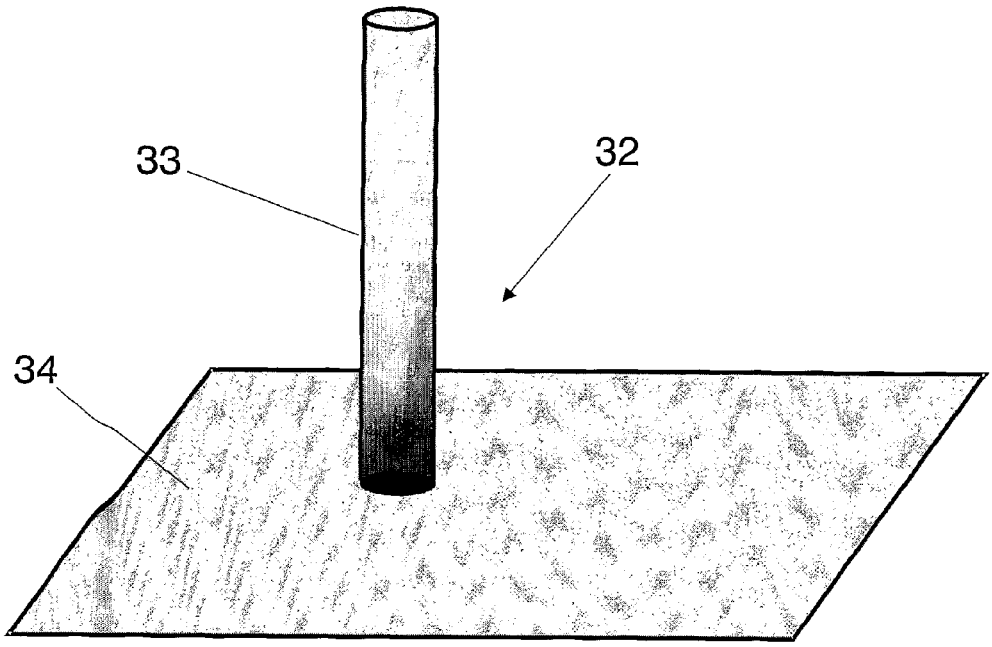
FIG.4A (Prior Art)
FIG. 4A is an example of the prior art.
Figure 4B:
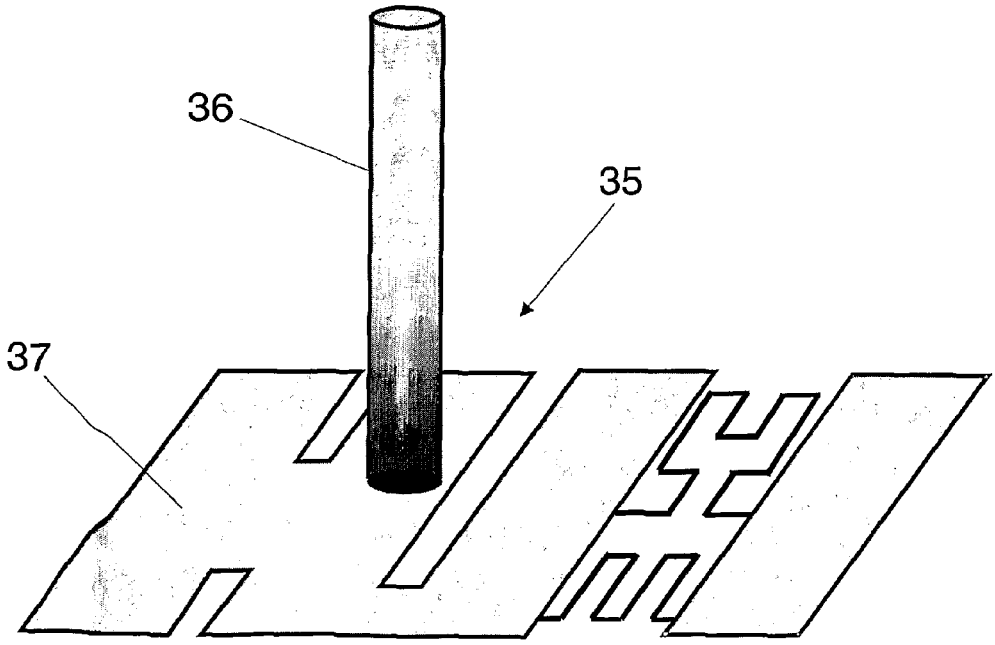
FIG. 4B is an example according to the present invention.
Figure 5A:
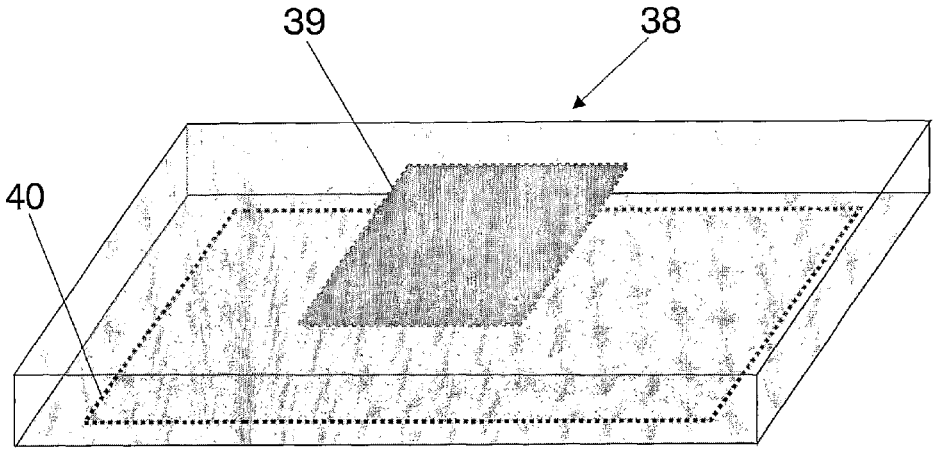
FIG.5A (Prior Art)
FIG. 5A is an example of the prior art.
Figure 5B:
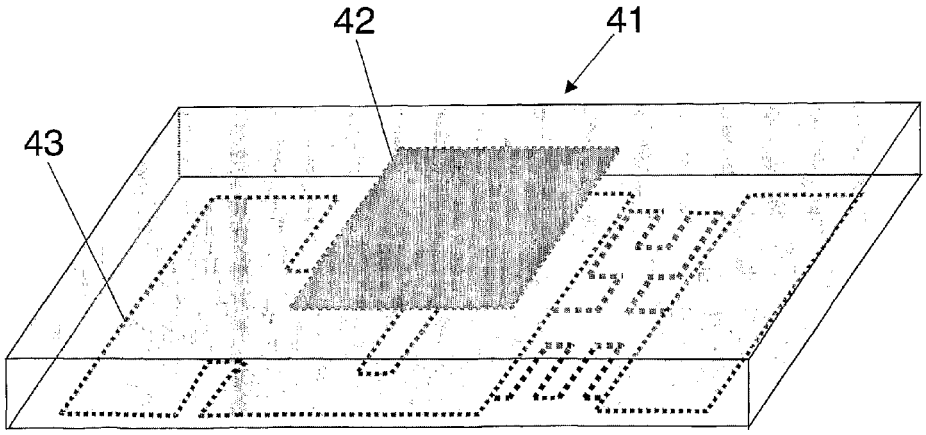
FIG. 5B is an example according to the present invention.

FIGS. 3B, 4B and 5B illustrate example antenna structures having multilevel ground-planes. The examples of FIGS. 3B, 4B and 5B are formed by modifying the ground-plane geometry of a conventional antenna design (3A, 4A and 5B, respectively). It should be understood that other antenna configurations could be similarly modified to include a multilevel ground-plane. In addition, novel antenna configurations could also be created using the multilevel and space-filling ground plane geometries, as described herein.

FIGS. 3A and 3B illustrate example planar inverted-F antenna (PIFA) structures. FIG. 3A shows a perspective view of a typical PIFA structure (22), and FIG. 3B shows a perspective view of a PIFA structure (27) having a multilevel ground-plane (31). With reference first to FIG. 3A, the conventional PIFA structure (22) includes a radiating element (25), a solid surface ground-plane (26), a feed point (24) coupled somewhere on the radiating element (25) (depending upon the desired input impedance), and a short-circuit (23) coupling the radiating element (25) to the ground-plane (26). The feed point (24) can be implemented in several ways, such a coaxial cable, the sheath of which is coupled to the ground-plane (26) and the inner conductor (24) of which is coupled to the radiating element (25). The radiating element (25) is usually shaped like a quadrangle, but other geometries are also possible. The shape and dimensions of the radiating element (25) will contribute in determining operating frequency of the overall antenna system. The ground-plane size and geometry also has an effect in determining the operating frequency and bandwidth for the PIFA.

In the example of FIG. 3B, the ground-plane (31) includes a multilevel structure. More particularly, the example PIFA (27) shown in FIG. 3B includes a radiating antenna element (30), a multilevel ground-plane (31), a feed point (29) coupled somewhere on the radiating antenna element (30), and a short-circuit (28) coupling the radiating antenna element (30) to the ground-plane (31). The example multilevel ground-plane (31) shown in FIG. 3B includes several quadrangular surfaces that are electromagnetically coupled by means of direct contact through conducting strips, and another quadrangular surface coupled by direct contact through a SFC and a meandering line. More precisely, the ground-plane (31) includes a multilevel structure formed from 5 rectangles, said multilevel structure being connected to a rectangular surface by means of SFC (8) and a meandering line with two periods. The surfaces of the example ground-plane are lying on a common flat surface, but other conformal configurations upon curved or bent surfaces could also be used. The edges between coupled rectangles in the illustrated ground-plane (27) are either parallel or orthogonal, but could be differently arranged in other embodiments.

FIGS. 4A and 4B illustrate example monopole antenna structures. FIG. 4A shows a perspective view of a typical monopole antenna structure (32), and FIG. 4B shows a perspective view of a monopole antenna structure (35) having a multilevel and space-filling ground-plane (37). More particularly, the conventional monopole antenna structure (32) illustrated in FIG. 4A includes a radiating element (33) and a solid ground-plane (34). In the example of FIG. 4B, the monopole antenna structure is modified by replacing the solid ground plane (34) with a multilevel ground plane (37). The radiating arm (36), (33) in the illustrated embodiments is cylindrical, however other monopole radiating arm structures could also be used, such as helical, zigzag, meandering, fractal, SFC, or other configurations.

FIGS. 5A and 5B illustrate another example antenna configuration. FIG. 5A shows a typical patch antenna configuration (38), and FIG. 5B shows a patch antenna structure (41) having a multilevel ground-plane (43). The conventional patch antenna (38) shown in FIG. 5A includes a polygonal patch (38) (e.g., square, triangular, pentagonal, hexagonal, rectangular, circular, multilevel, fractal, etc.) and a solid ground-plane (40), both disposed on a dielectric substrate. The example patch antenna (41) shown in FIG. 5B includes a radiating element (42) (that can have any shape or size) and a multilevel ground-plane (43), both disposed on a dielectric substrate. The patch antenna (41) may, for example, be fabricated using etching techniques as used to produce PCBs, by printing the radiating element (42) and ground-plane (43) onto the substrate using a conductive ink, or by other conventional means. For example, a low-loss dielectric substrate (such as glass-fiber, a teflon substrate such as Cuclad® or other commercial materials such as Rogers® 4003) can be placed between the patch element (42) and the ground-plane (43). Different antenna feeding schemes for patch antennas can be used, for instance: a coaxial cable with the outer conductor connected to the ground-plane (43) and the inner conductor connected to the patch element (42) at the desired input resistance point; a microstrip transmission line sharing the same ground-plane (43) as the antenna with the strip capacitively coupled to the patch (42) and located at a distance below the patch, or alternatively with the strip placed below the ground-plane and coupled to the patch through an slot, a microstrip transmission line with the strip co-planar to the patch, or others.

FIGS. 6-18 illustrate several additional example geometries for multilevel ground-planes. The ground-plane geometries shown in FIGS. 6-18 may, for example, be used in the antenna structures shown in FIGS. 3B, 4B and 5B, or may be used in other antenna structures.

Figure 6:
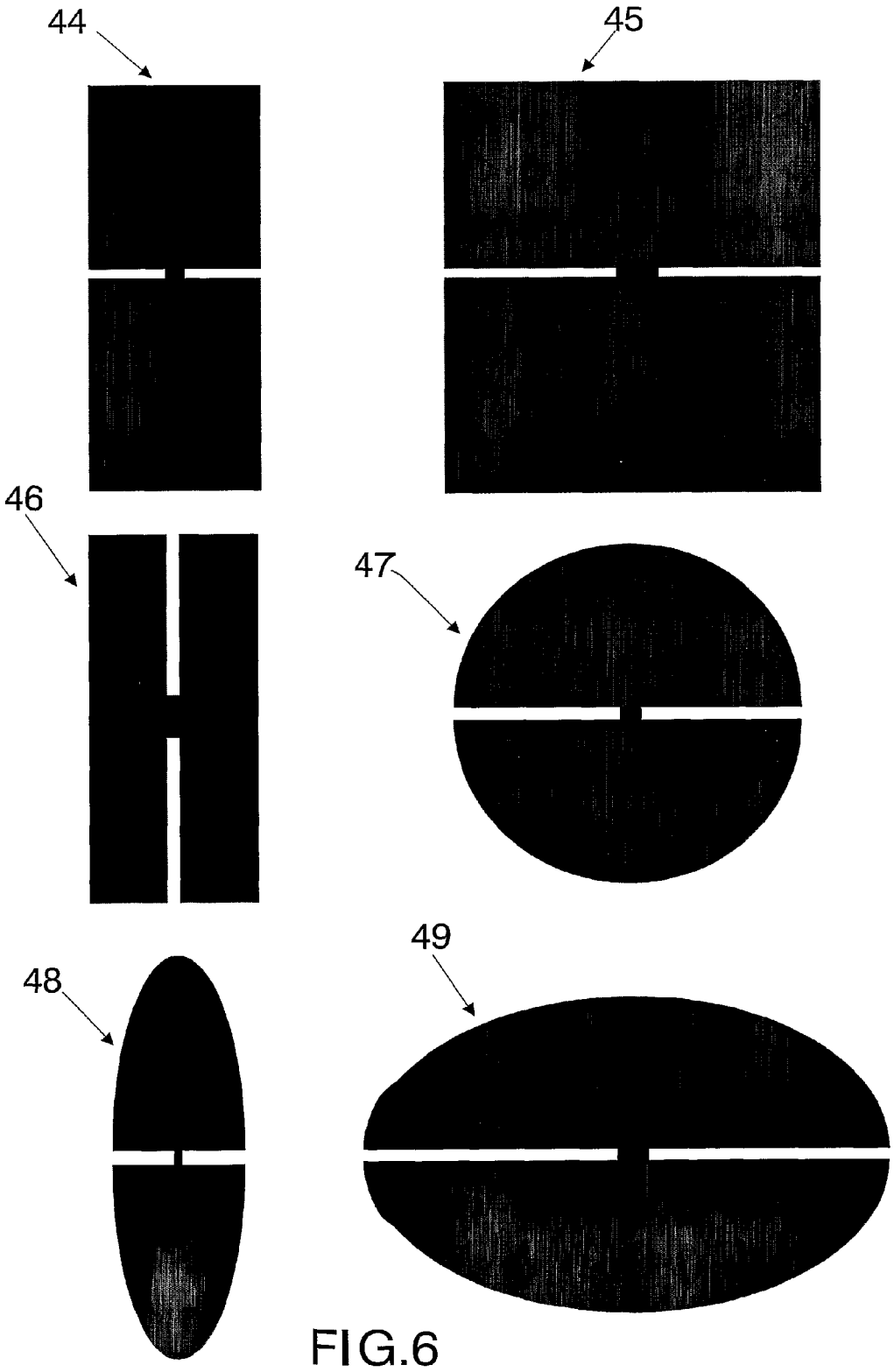
FIG. 6 to FIG. 18.—illustrate several additional examples of geometries for multilevel ground-planes.

FIG. 6 shows several examples of different contour shapes for multilevel ground-planes, such as rectangular (44, 45, and 46) and circular (47, 48, and 49). In this case, circles and ellipses are polygons with an infinite number of sides.

Figure 7:
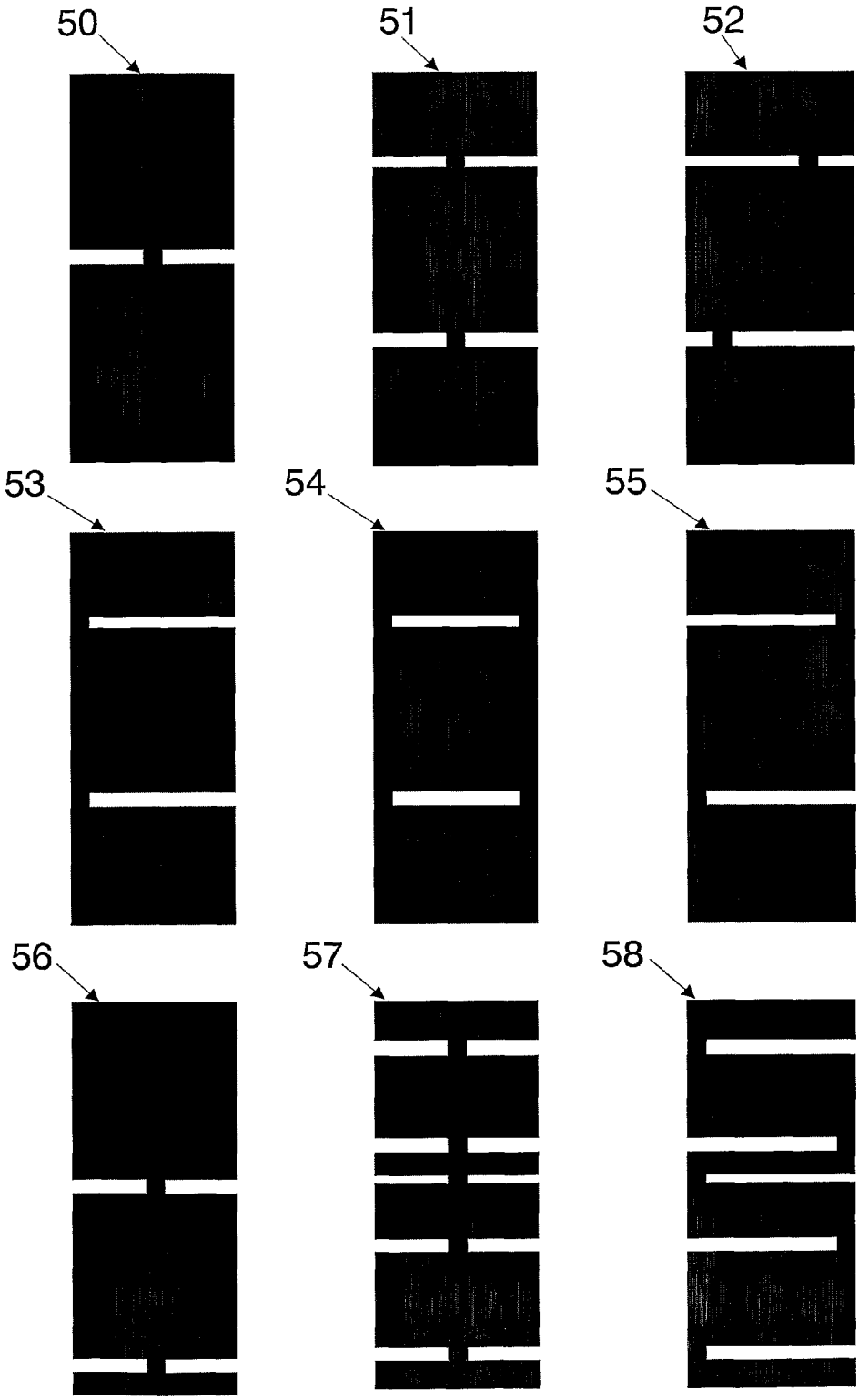

FIG. 7 shows a series of same-width multilevel structures (in this case rectangles), where conducting surfaces are being connected by means of conducting strips (one or two) that are either aligned or not aligned along a straight axis.

Figure 8:
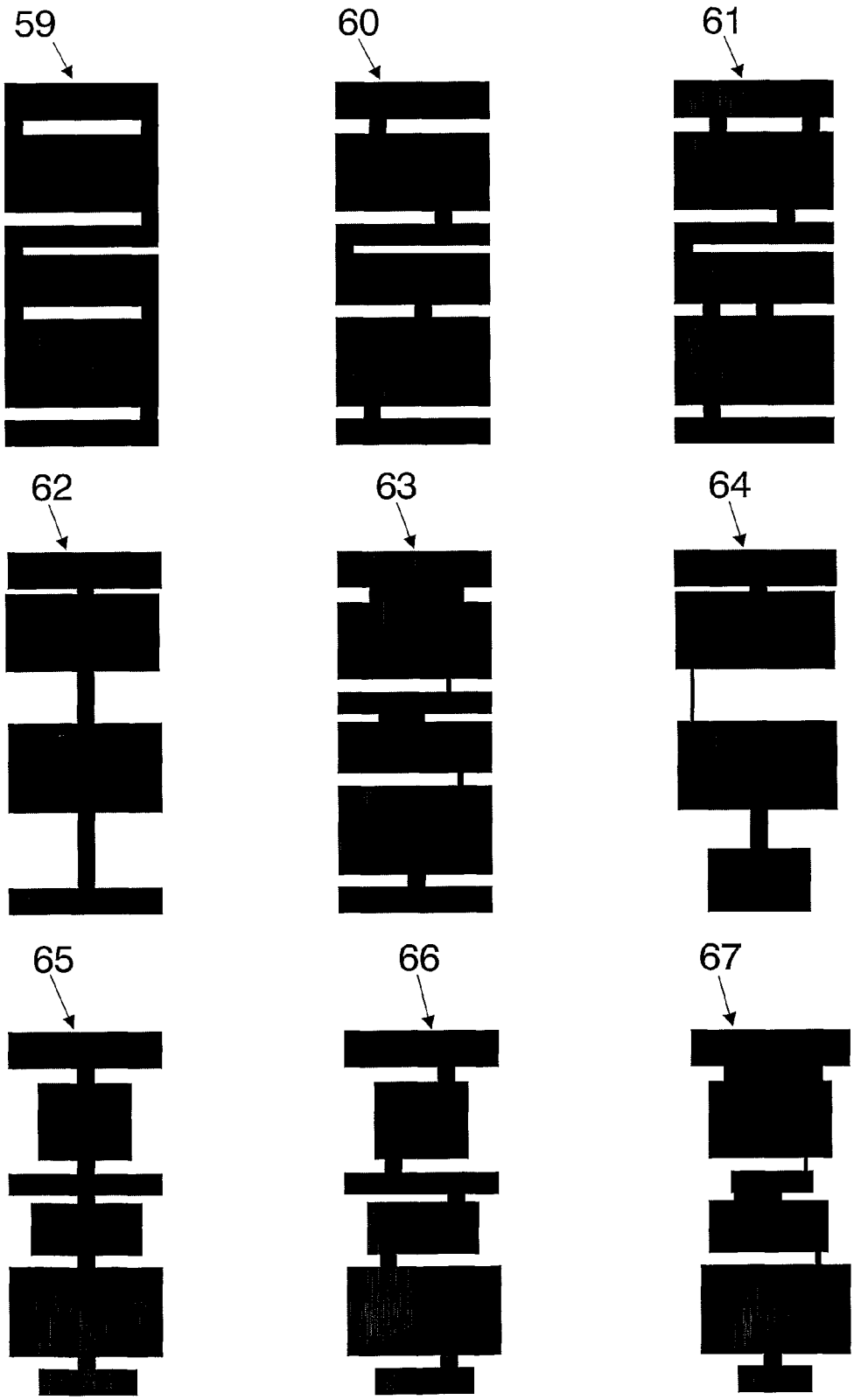

FIG. 8 shows additional example multilevel ground-plane geometries (59-67). As illustrated, a multilevel ground-plane may include conducting surfaces and conducting strips with varying lengths and widths. In addition, more than one conducting strips may be used to interconnect the conducting surfaces, as shown in geometries (59) and (61).

Figure 9:
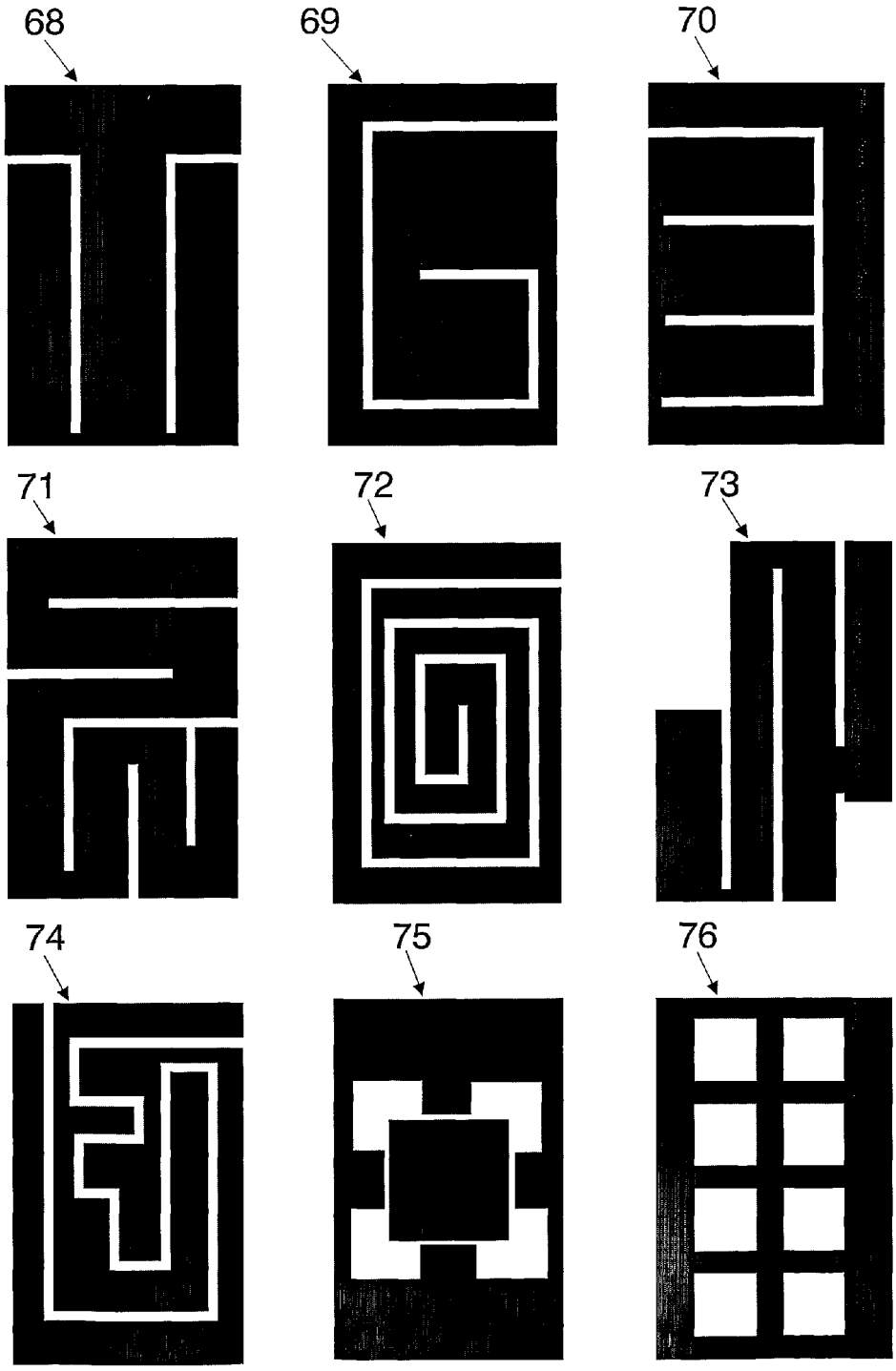

FIG. 9 shows several additional examples of multilevel ground-planes (68-76). The illustrated ground-plane examples (68-76) are formed from rectangular structures, however other shapes could be used.

Figure 10:
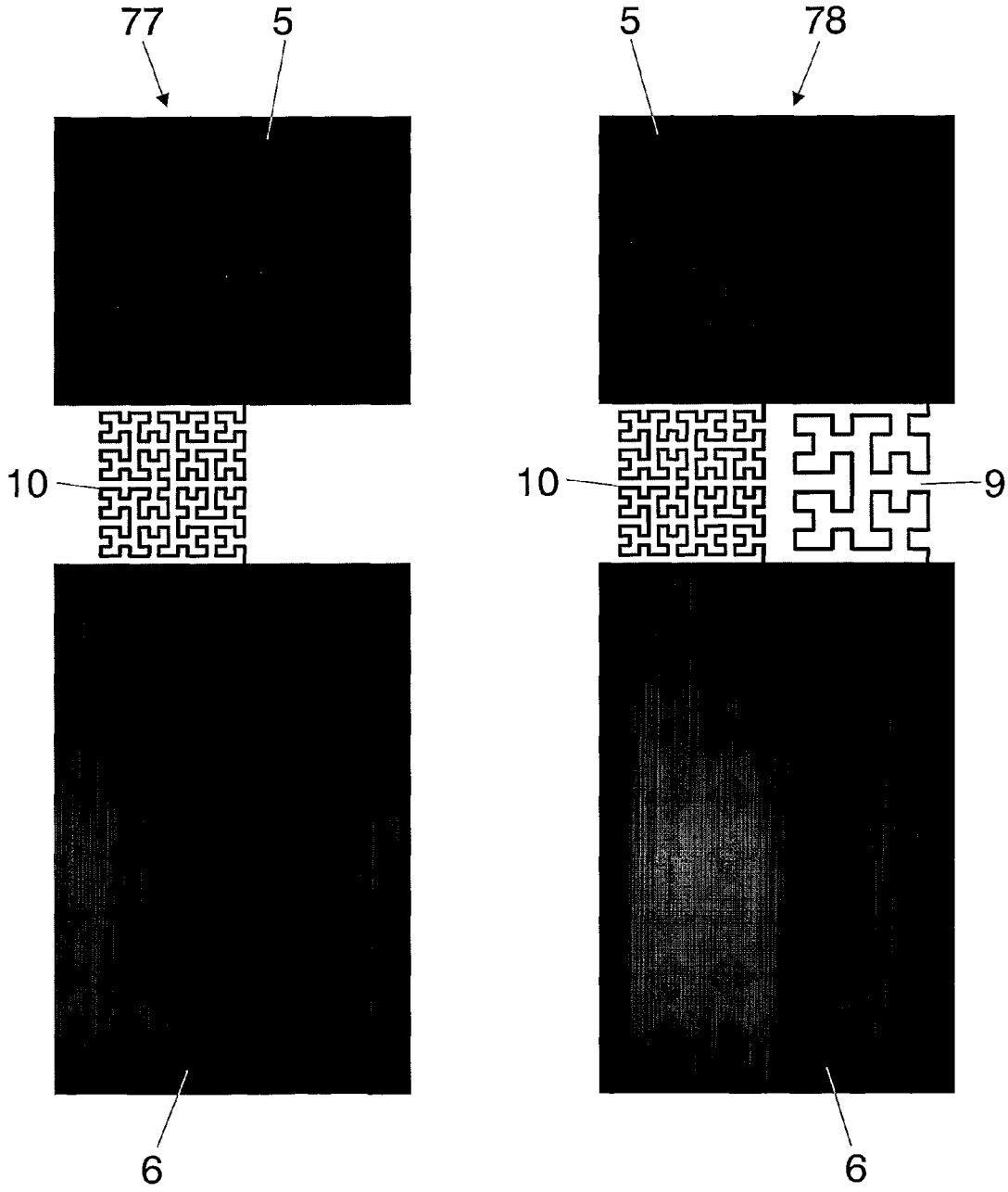

FIG. 10 shows two example multilevel ground-planes (77), (78). The illustrated ground planes (77), (78) both include two conducting surfaces (5), (6) that are connected by one or more SFCs (9), (10).

Figure 11:
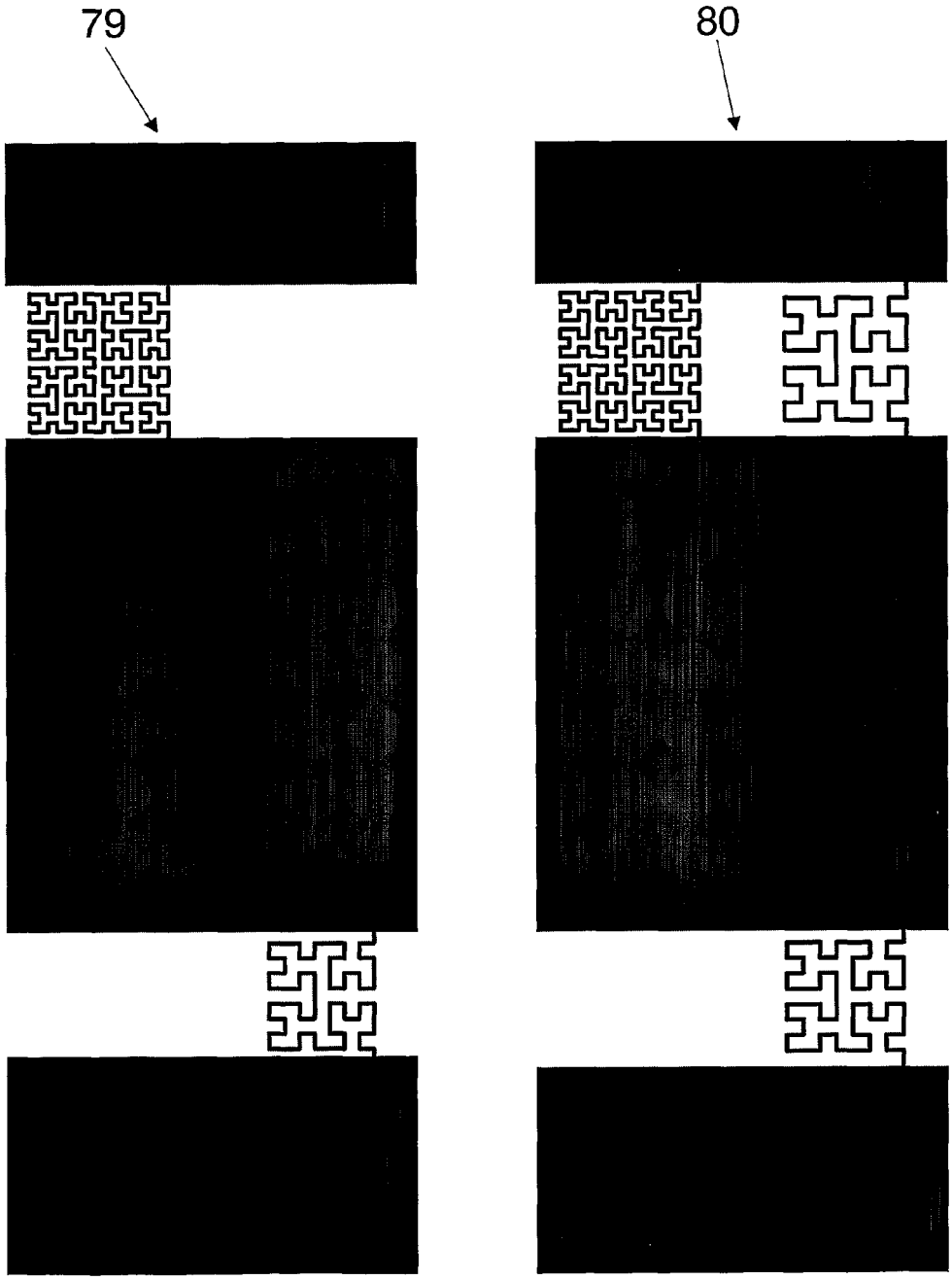

FIG. 11 shows two additional example multilevel ground-planes (79), (80). In these two examples, three conducting surfaces are connected with by one or more SFCs.

Figure 12:
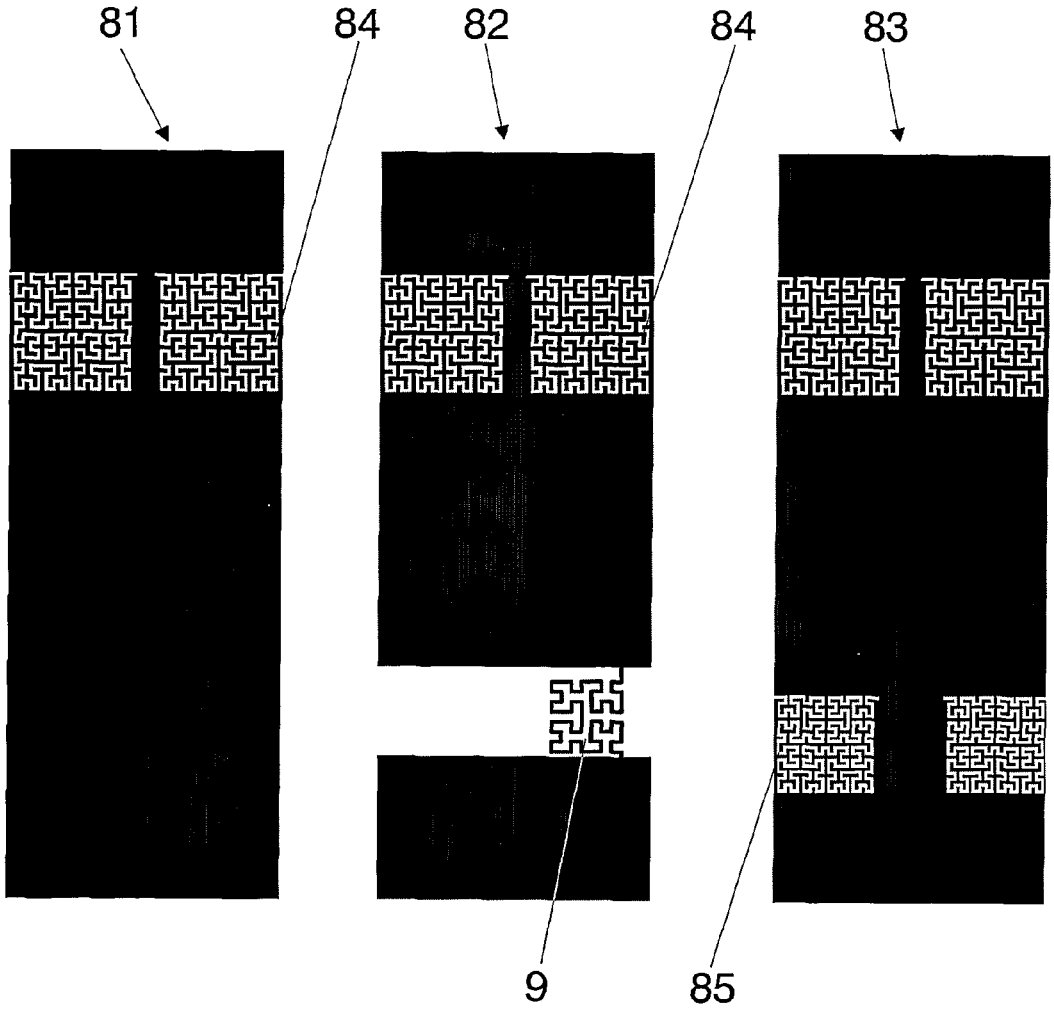

FIG. 12 shows three example multilevel ground-planes (81-83). In these examples, at least one of the gaps (84), (85) between conducting surfaces are shaped as SFCs. In particular, the gaps (84) and (85) between conducting surfaces are shaped as SFCs.

Figure 13:
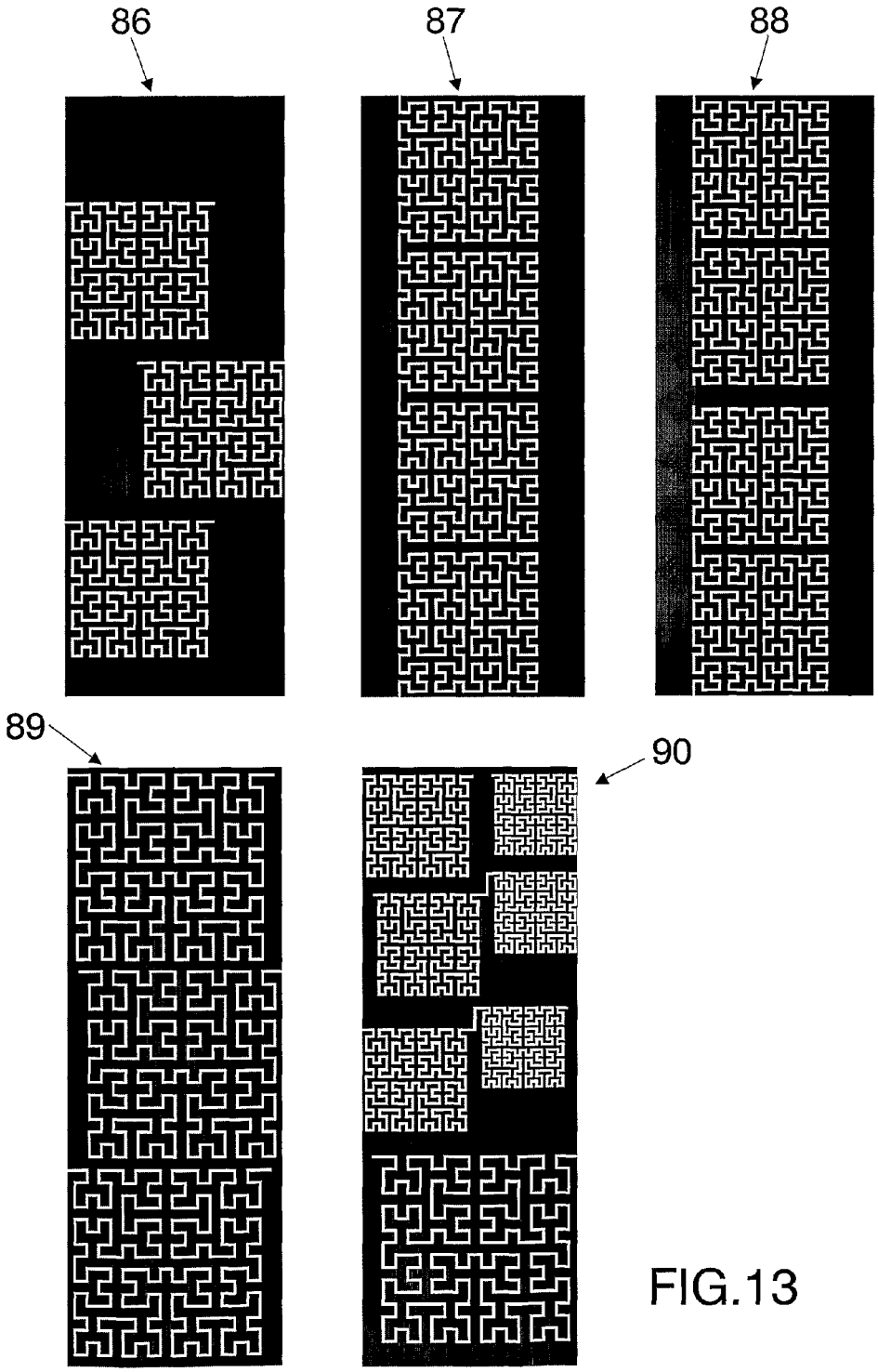

FIG. 13 shows another set of example multilevel ground-planes (86-90) in which portions of the ground-plane structure are shaped as SFCs.

Figure 14:
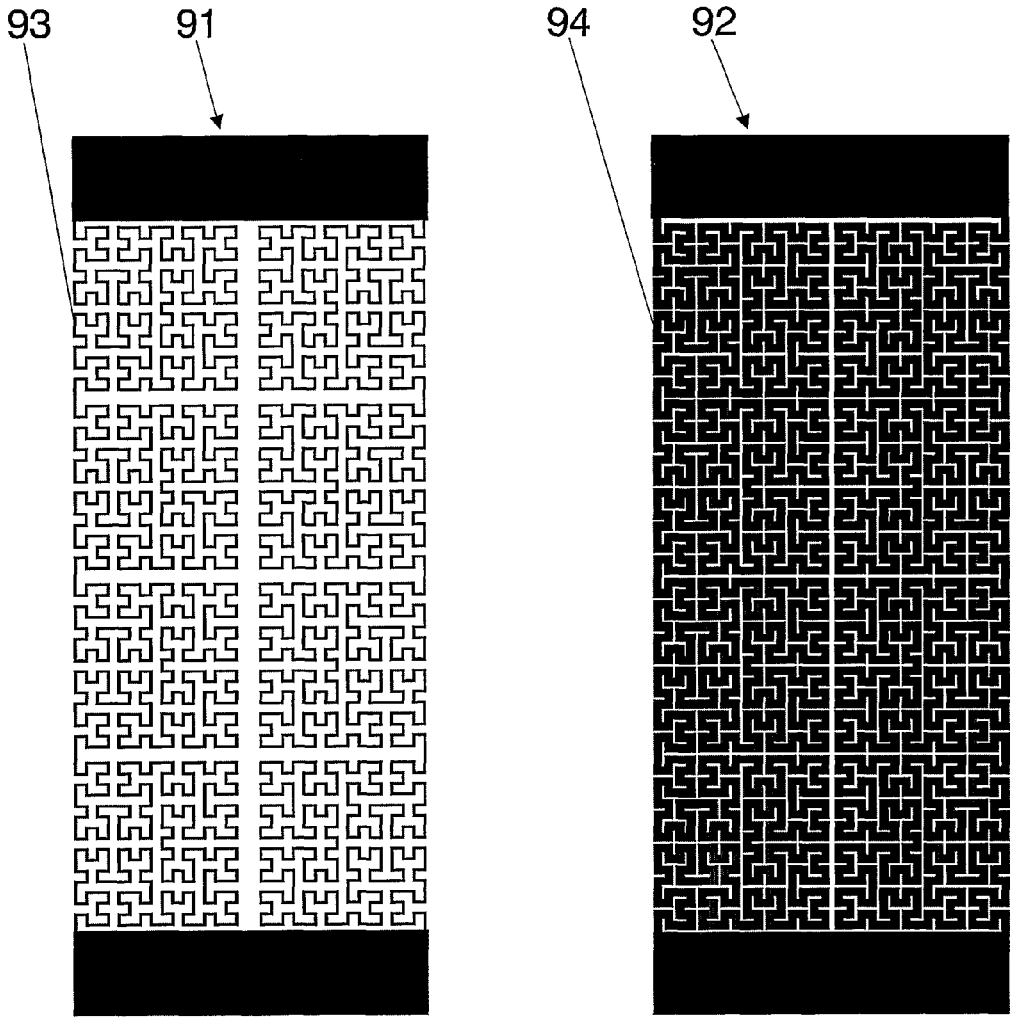

FIG. 14 shows two additional example multilevel ground planes (91), (92). Depending on the application, configuration (91) can be used to minimize the size of the antenna while configuration (92) may be used to enhance bandwidth in a reduced size antenna while reducing the backward radiation.

Figure 15:
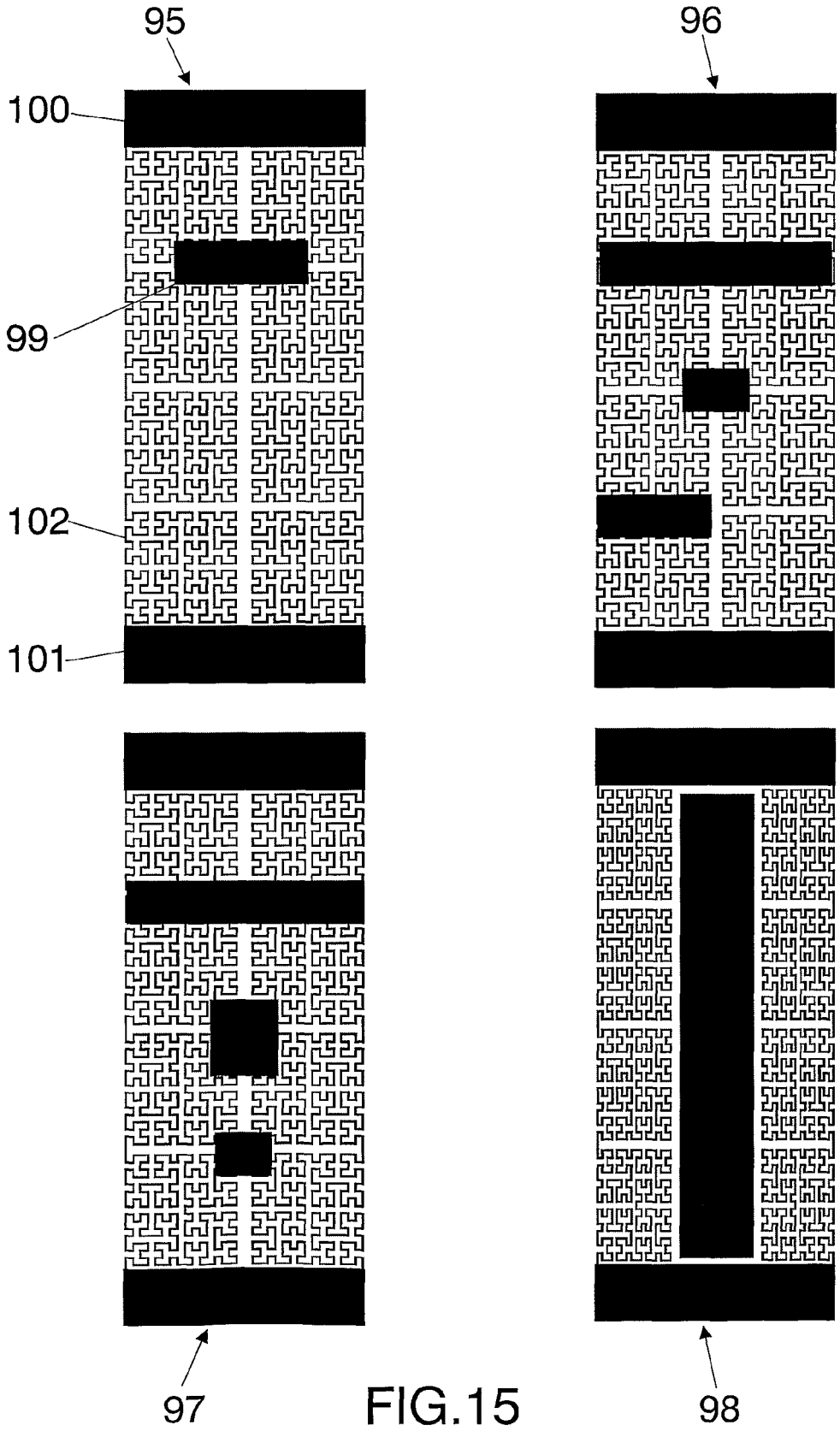

FIG. 15 shows another example set of multilevel ground planes (95-98). In these examples, conducting surfaces with different widths are connected by SFC conducting strips, either by direct contact (e.g., 95, 96, 97, 98) or by capacitive effect (e.g., the central strip in 98).

Figure 16:
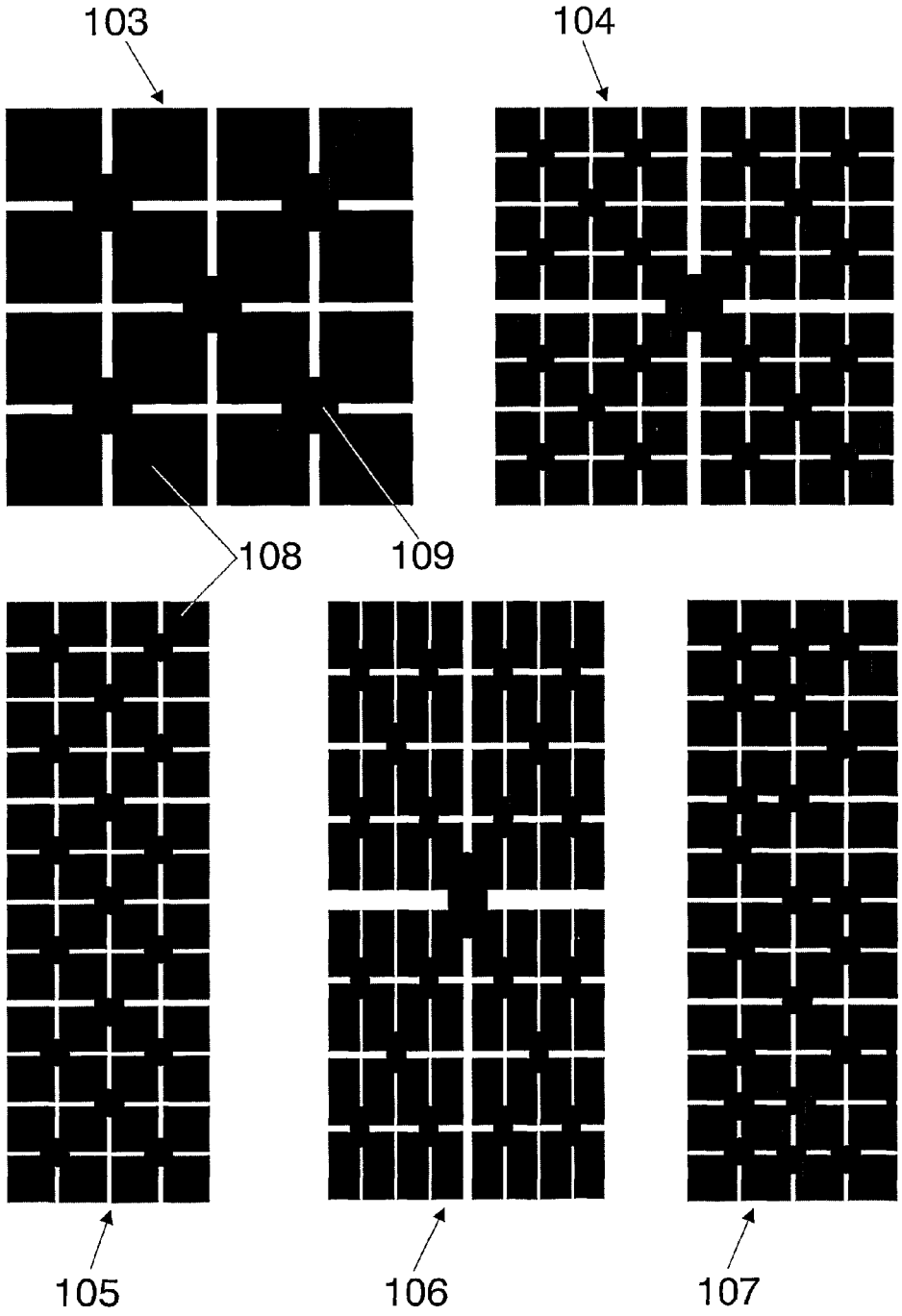

FIG. 16 shows several additional example multilevel ground-planes. The illustrated examples (103-107) are formed by rectangles, but could be formed from different shapes in other examples.

Figure 17:
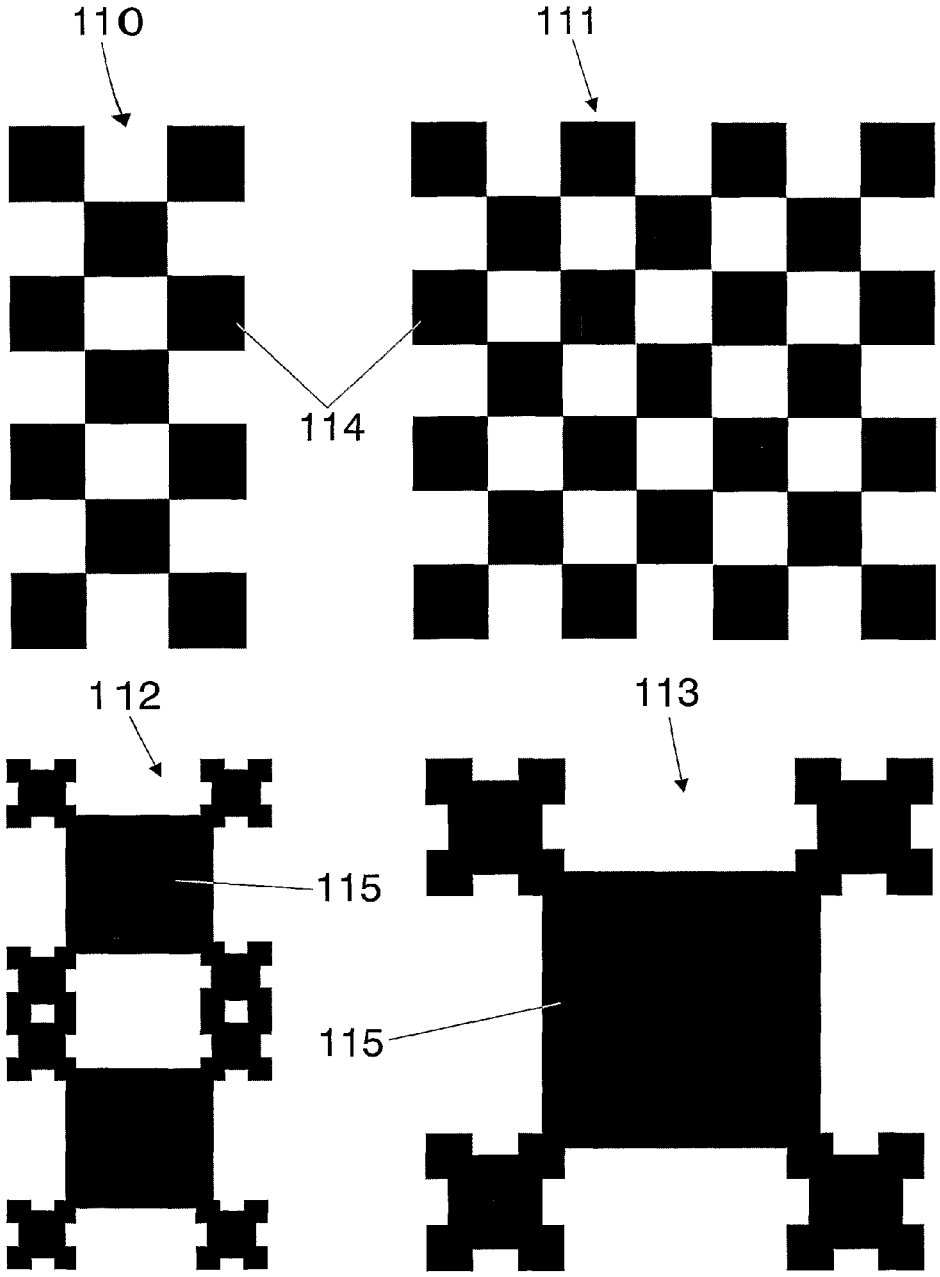

FIG. 17 shows four additional examples of multilevel ground-planes (110-113). In these examples, the ground-planes are formed by interconnected squares.

Figure 18:
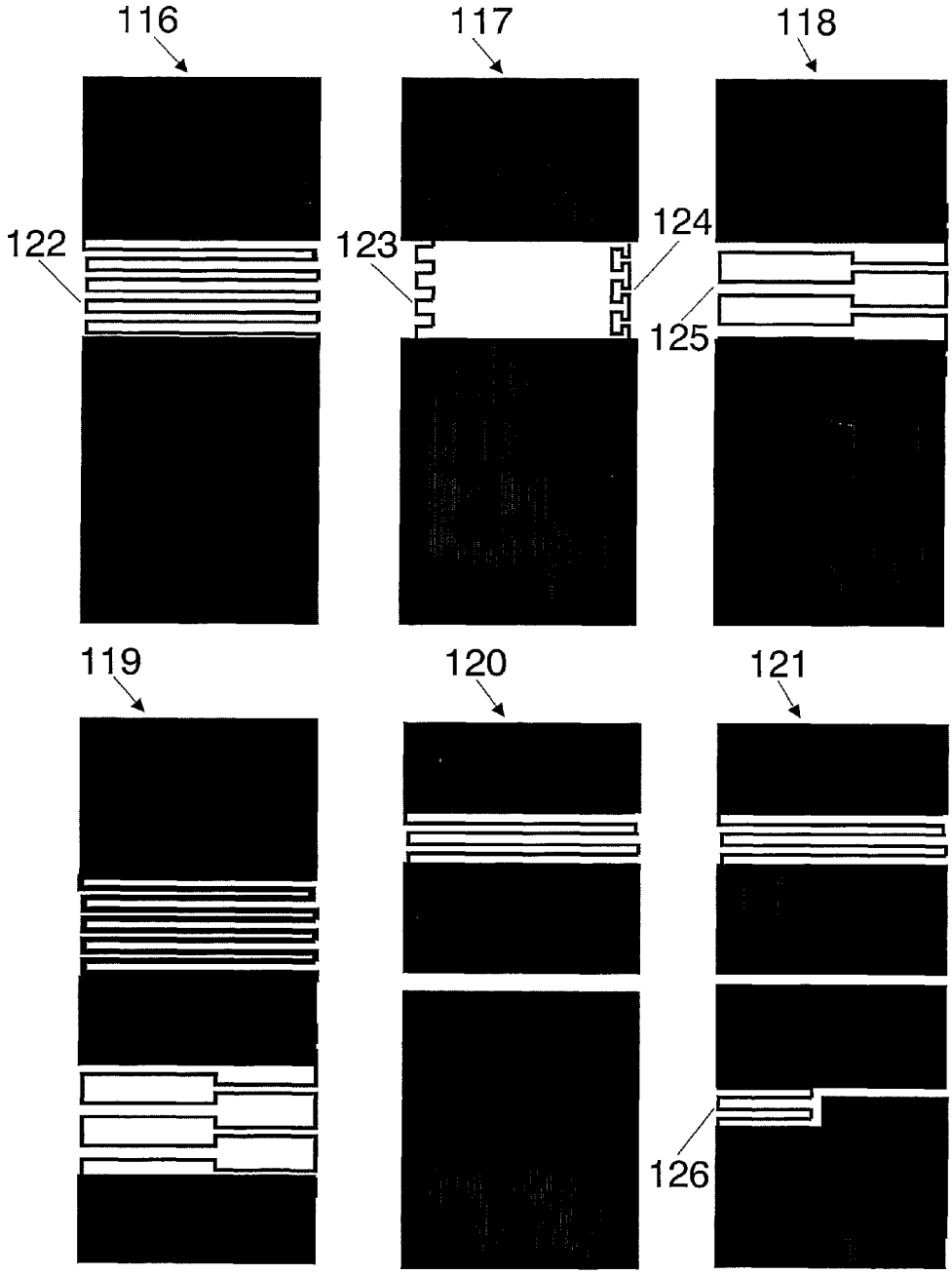

FIG. 18 shows examples (116-121) of multilevel ground-planes where at least two conducting surfaces are connected through meandering curves with different lengths or geometries. In other examples, one or more of the meandering lines could be replaced by SFCs. Replacing one or more meandering lines with SFCs may, for example, achieve a further size reduction or a different frequency behaviour of the antenna.

As illustrated in the examples described above, the conducting strip(s) connecting the surfaces of the ground-plane can be placed at the center of the gaps, as shown in FIG. 6 and ground-plane geometries (2, 50, 51, 56, 57, 62 and 65), or distributed along several positions as shown in other illustrations (e.g., 52 and 58.) In some examples, the conducting surfaces may have the same width (e.g., FIG. 1 and FIG. 7), but in other examples conducting surfaces with different widths may be used (e.g., drawings 64 through 67 in FIG. 8.) The conducting surfaces and/or conductive strips are linearly arranged with respect to a straight axis in some examples (e.g., 56 and 57), while in other examples they are not centered with respect to an axis. The conductive strips can also be placed at the edges of the overall ground-plane (e.g., geometry 55), or can become arranged in a zigzag or meandering pattern (e.g., geometry 58) where the strips are alternatively and sequentially placed at the two longer edges of the overall ground-plane.

In some examples, (e.g., 59 and 61), several conducting surfaces are coupled by means of more than one strip or conducting polygon. This geometry may be advantageous if a multiband or broadband behaviour is to be enhanced. Such multiple strip geometries allow multiple resonant frequencies which can be used as separate bands or as a broad-band if properly coupled. In addition, multiband or broad-band behaviour can be obtained by shaping the conductive strips with different lengths within the same gap.

In other examples, conducting surfaces are connected by means of strips with SFC shapes, as illustrated in FIGS. 3, 4, 5, 10, 11, 14, and 15. In these configurations, SFCs can cover more than 50% of the area covered by the ground-plane, as shown in the examples of FIG. 14. In other examples, the gap between the conducting surfaces is shaped as a SFC, as shown in FIG. 12 or 13. In some examples, SFCs feature a box-counting dimension larger than one (at least for an octave in the abscissa of the log-log graph used in the box-counting algorithm) and can approach the so called Hilbert or Peano curves or even some ideally infinite curves known as fractal curves.

Figure 19:
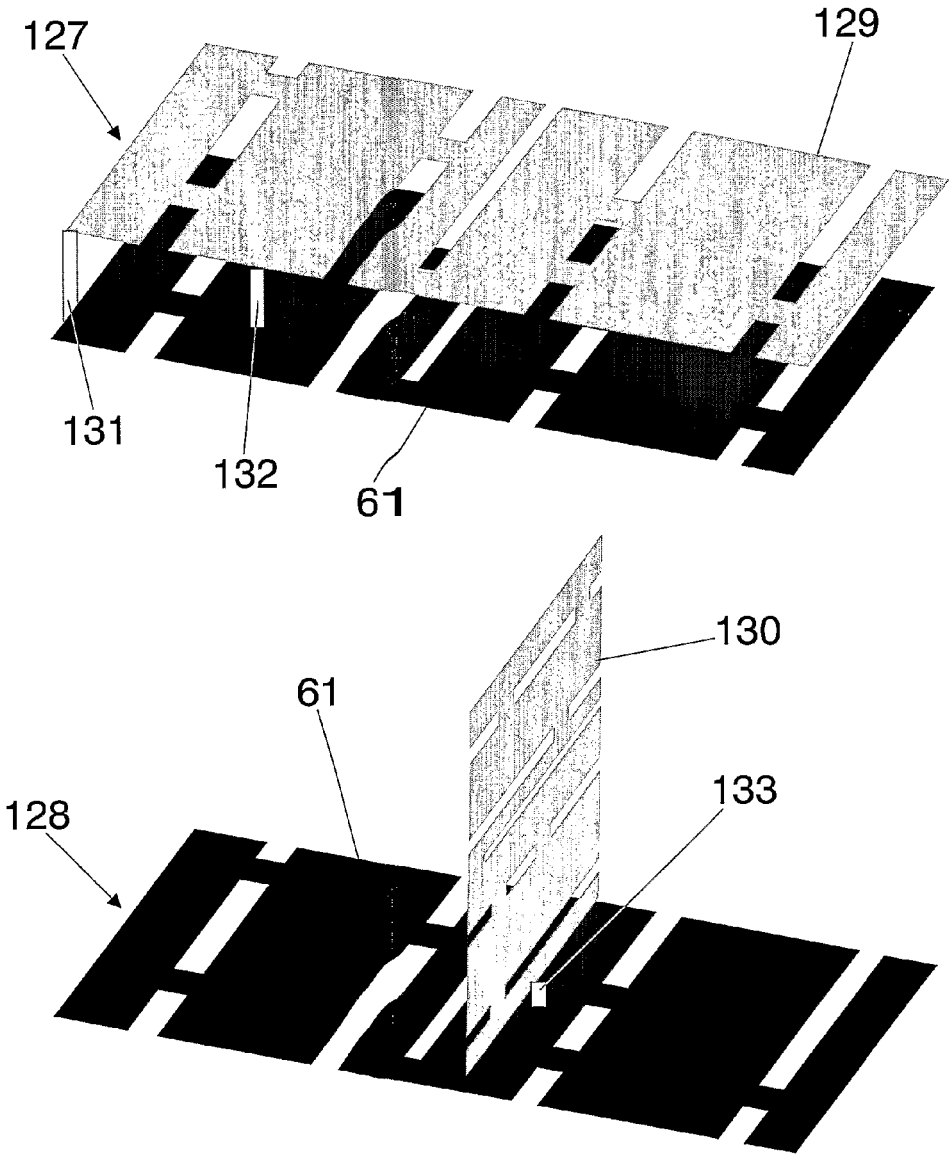
FIG. 19.—shows two perspective view of examples of antenna structures in which the radiating element is shaped similarly to the multilevel ground-plane.

FIG. 19 shows two example antenna structures (127), (128) in which the radiating element (129), (130) is shaped similarly to the multilevel ground-plane (61). In this manner, a symmetrical or quasymmetrical configuration is obtained in which the resonances of the ground-plane (61) and the radiating element (129), (130) combine to enhance the antenna behaviour. FIG. 19 illustrates an example of a microstrip antenna (127) and a monopole antenna (128) using this configuration. The example microstrip antenna (127) includes a short-circuited radiating element (129) with shorting conductor (131), a feeding point (132) and a multilevel ground-plane (61). The monopole antenna (128) includes a radiating element (130), a multilevel ground-plane (61) and a feeding point (133).

Figure 20:
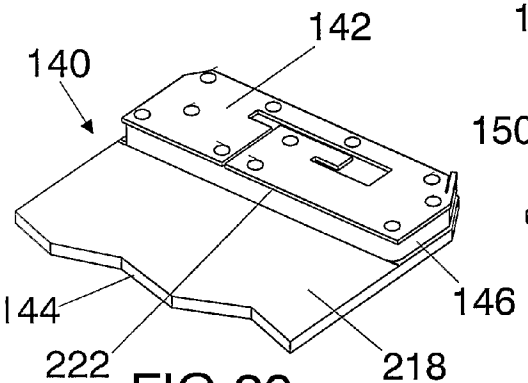
FIG. 20.—shows a perspective view of an antenna system for a mobile device, wherein only one part of the printed circuited board has been represented.

FIGS. 20-23C show an example antenna for a mobile device. With reference first to FIG. 20, the antenna structure (140) includes a radiating element (142) that is connected to a printed circuit board (PCB) (144) using a dielectric mounting structure (146). One of the layers of the PCB (144) includes a multilevel ground-plane (218), as described above. In most instances, the PCB (144) will include a multilayer substrate, wherein the ground-plane is embedded as one of the PCB conducting layers.

Figure 22:
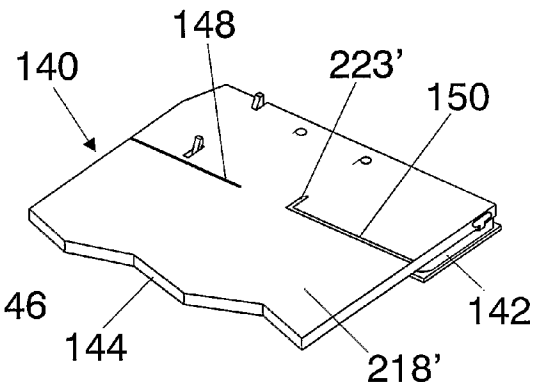
FIG. 22.—shows a perspective bottom view of an antenna system for a mobile device of FIG. 21.
Figure 21:
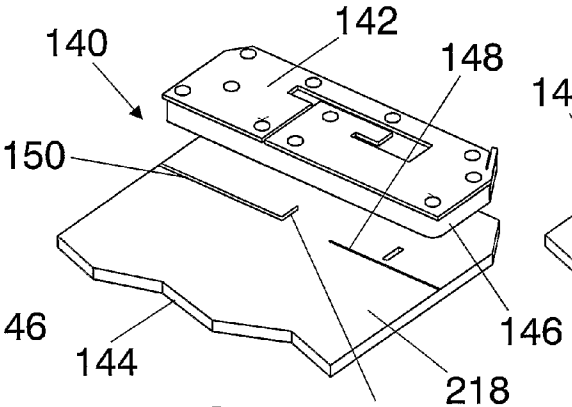
FIG. 21.—shows the same view of FIG. 20 with the radiating element spaced apart from the ground plane.

FIG. 21 is an exploded view of the example antenna, showing two slots (148), (150) that are cut through one or more layers of the PCB (144). The slots (148), (150) extend at least through a ground-plane layer of the PCB (144), forming a multilevel ground-plane structure having two conducting surfaces that are connected by a conducting strip as previously shown in FIG. 1 (the conducting strip in this example is formed between the two slots (148), (150.) A rear view of the example antenna (140) is provided in FIG. 22, illustrating that the slots (148), (150) extend through each layer of the PCB (144) in this example. More in particular, in this preferred embodiment the printed circuit board (144) is provided with a conducting layer on its upper face in which an upper ground plane (218) is formed. In the lower face of the printed circuit board (144) is provided a lower ground plane (218'). The upper and the lower ground planes may have the same shape as shown in FIGS. 21 and 22, although the width of the slots of one ground plane, may be greater than the width of the slots of the other ground plane.

Figure 23C:
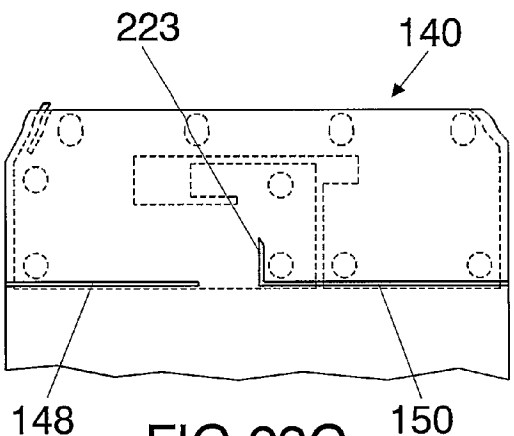
FIG. 23*c* is a bottom plan view of the same figure.
Figure 23B:
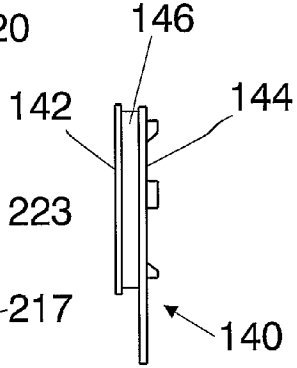
FIG. 23*b* shows a side view.
Figure 23A:
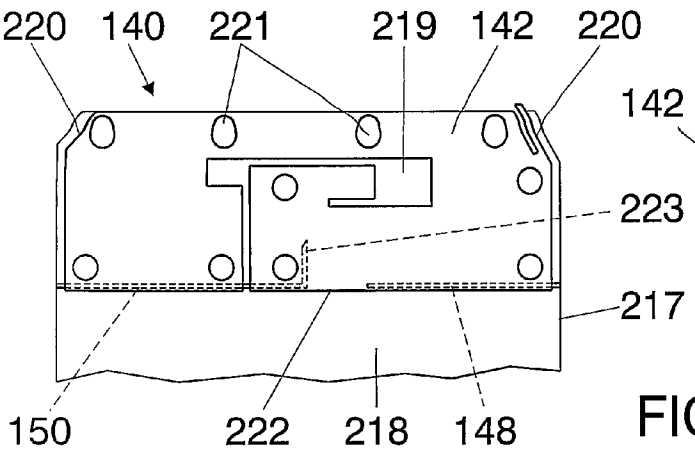
FIG. 23.—shows in FIG. 23*a* a top plan view of the embodiment of FIG. 20.
Figure 26:
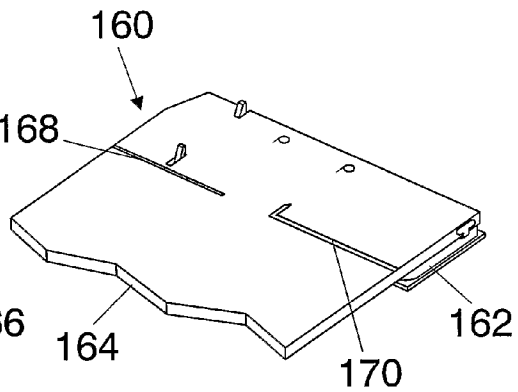
FIG. 26 and FIG. 30.—show a similar view than the one on FIG. 22.
Figure 25:
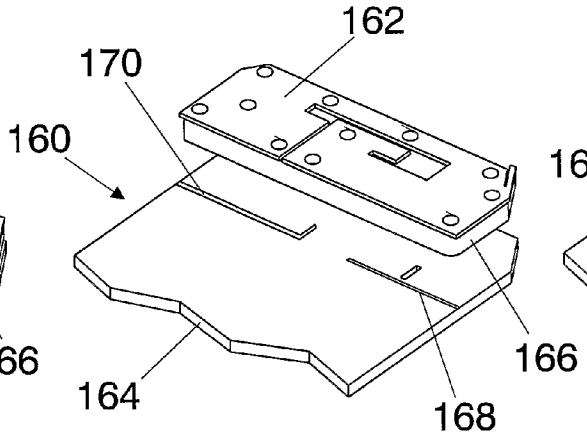
FIG. 25 and FIG. 29.—show a similar view than the one on FIG. 21.
Figure 24:
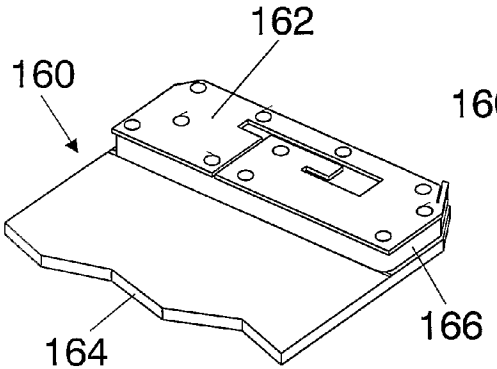
FIG. 24 and FIG. 28.—show a similar view than the one on FIG. 20.
Figure 27C:
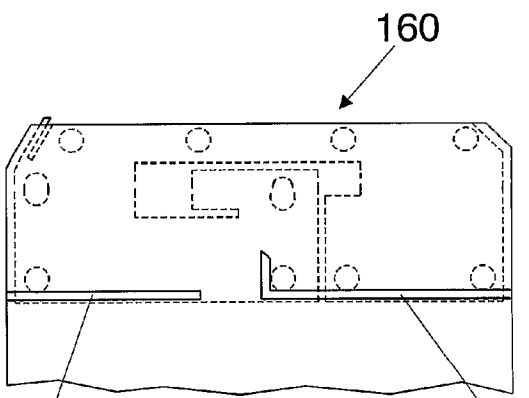
FIG. 27 and FIG. 31.—show a similar view than the one on FIG. 23.
Figure 27B:
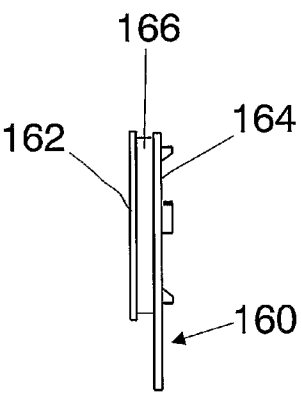
Figure 27A:
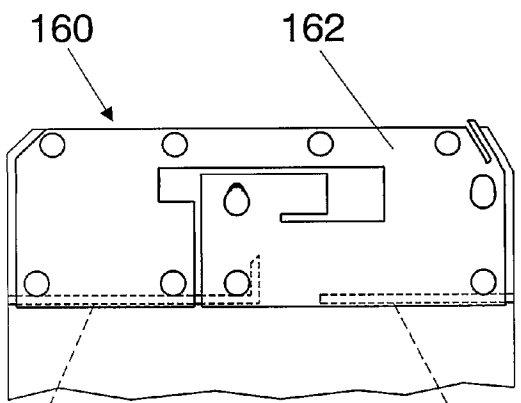
Figure 30:
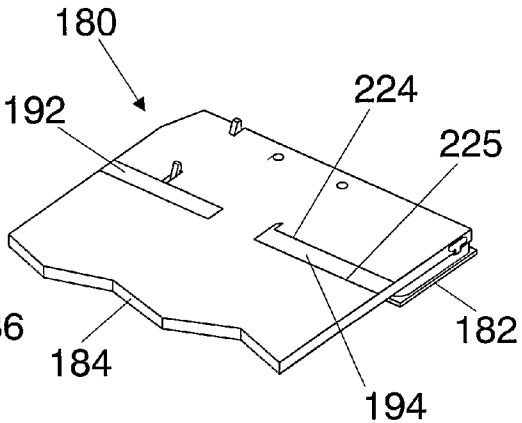
Figure 29:
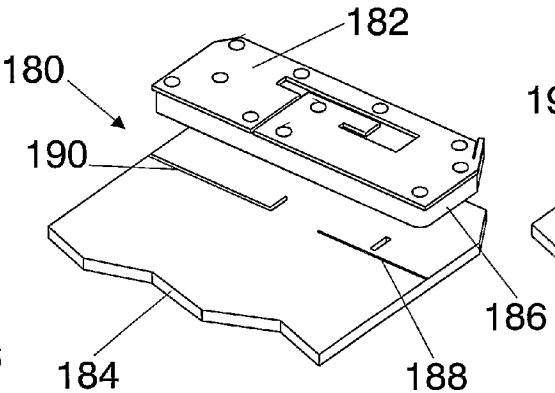
Figure 28:
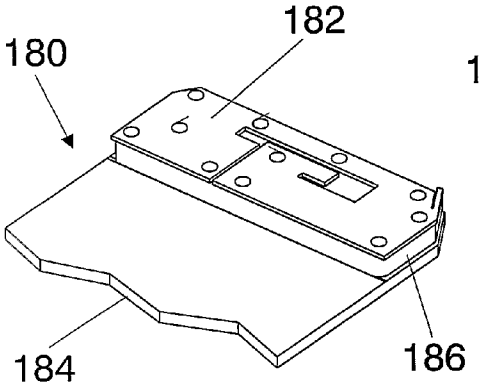

As shown for instance in FIG. 23*a*, at least one slot (148), (150) is in contact at one of its ends with the perimetric edge (217) of the ground plane (218). Preferably, the slots (148), (150) are aligned and are substantially parallel to one side of the perimetric edge (217) of the ground plane (218).

In a preferred embodiment, the slots (148), (150) and the edge (222) of the radiating element (142) placed over said slots (148),(150), are substantially straight, and the edge (222) of the radiating element extends over the two slots (148), (150).

As it can be seen for instance on FIG. 21, the slot (150) is provided with a slot segment (223) at one of its ends, so that said slot segment (223) defines an angle, (90° in this case), with respect to said slot (150) and is placed below the radiating element (142).

FIGS. 23A-23C are a schematic view of the antenna illustrating an example alignment of the radiating antenna element (142) and the slots (148), (150) through the multilevel ground-plane. The gaps between the conducting surfaces of the ground-plane (e.g., slots (148), (150) may be substantially aligned with at least one edge of the radiating antenna element (142) in order to improve performance of the antenna (140). Antenna performance may also be improved by including the slots (148), (150) through each layer of the PCB (144). In addition, for a cellular device operating at a typical cellular frequency between 800 MHz and 3000 MHz, antenna performance may be further improved by cutting the slots with a width in the range of about 0.3 mm to about 3 mm.

Antenna performance may also be improved by using the following design constraints. Grounded pads or tracks should not be placed over the slots (148), (150). If the strip formed between the two slots (148), (150) is used to embed a RF transmission line, then the transmission line should be a stripline, a co-planar line or a buried counter-part of the same. The ground surfaces located between the slots (148), (150) should include vias that ground any multiple ground layers in the PCB. The portions of the antenna that operate within a determined band should be positioned close to the slots (148), (150), such that at least a portion is positioned over the slots (148), (150).

FIGS. 24-27C show another example antenna (160) for a mobile device. This example is similar to the example described above with reference to FIGS. 20-23C, except that the slots (168), (170) in this example are greater in width. Increasing the width of the slots (168), (170) may improve antenna performance.

FIGS. 28-31C show a third example antenna (160) for a mobile device. In this example, the slots (188), (190) in the PCB layer closest to the radiating antenna element (182) are smaller in width than the slots (192), (194) in the other layers of the PCB (184). For example, in a cellular device operating at a typical cellular frequency between 800 MHz and 3000 MHz, the slots (188), (190) closest to the radiating antenna element (182) may have a width in the range of about 0.3 mm to about 3 mm, while the slots (192), (194) through other layers of the PCB (184) have a width greater than 3 mm.

Figure 32:
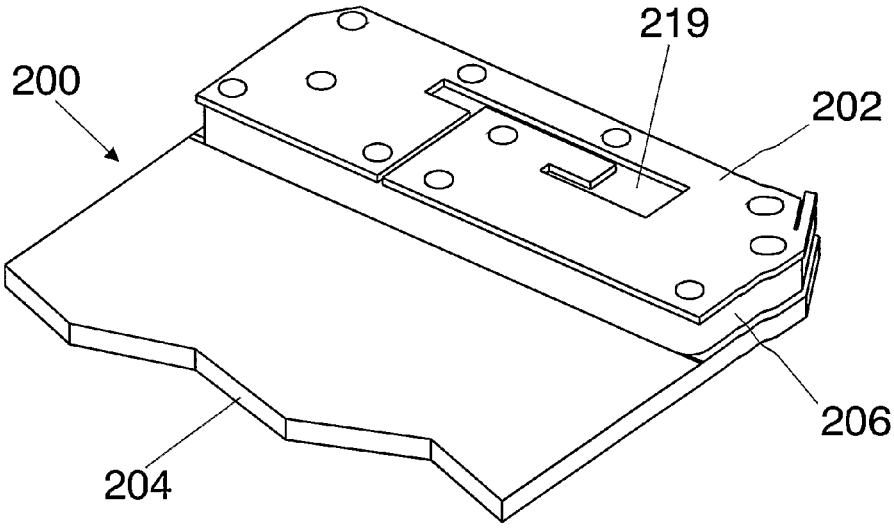
FIG. 32.—shows a similar view than the one on FIG. 20.
Figure 33:
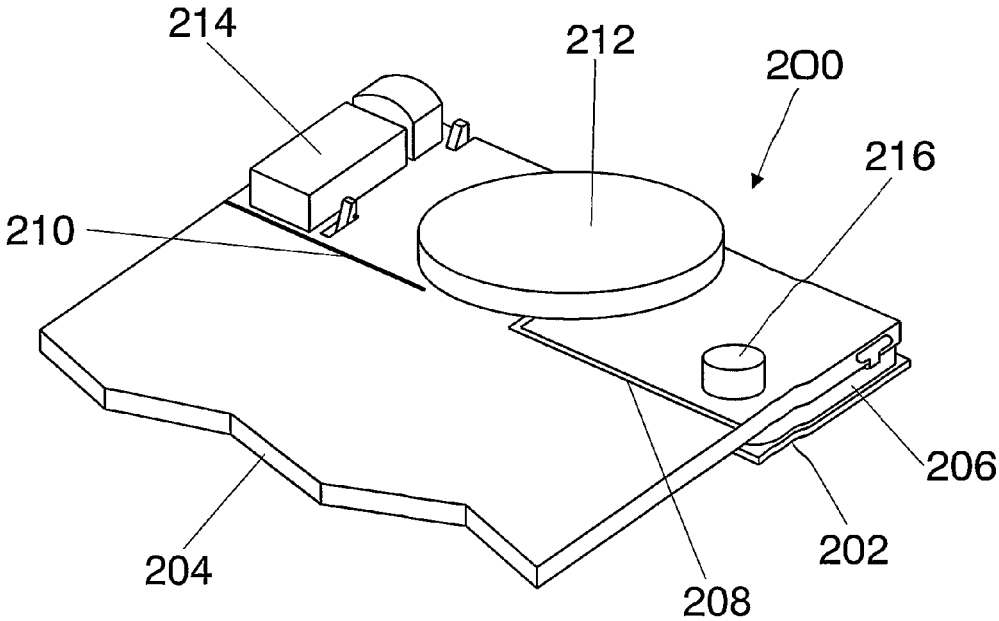
FIG. 33.—shows in perspective the bottom face of an example of antenna for a mobile device, wherein other mobile device components are mounted on a surface of the printed circuit board opposite the radiating antenna element.

FIGS. 32 and 33 show an example antenna (200) for a mobile device, wherein other mobile device components (212), (214), (216) are mounted on a surface of the PCB opposite the radiating antenna element (202). FIGS. 32 and 33 illustrate that the antenna structure, described herein, conserves space inside a mobile device, possibly enabling other components (212), (214), (216) (e.g., speakers, vibration mechanisms, etc) to be mounted on the PCB (204) opposite an antenna structure.

Figure 31C:
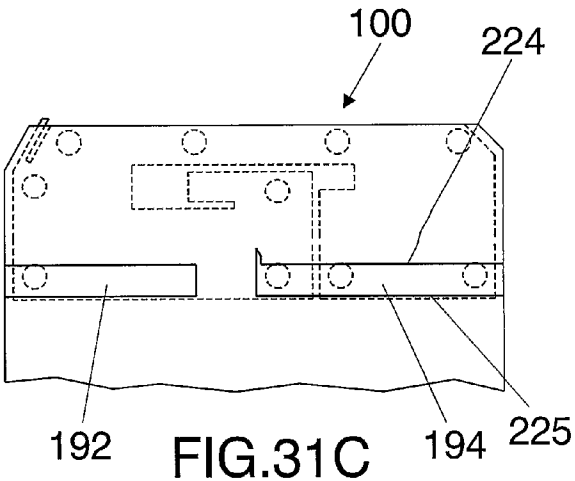
Figure 31B:
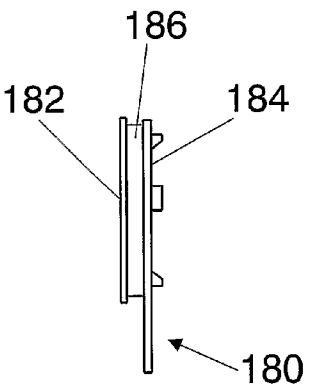
Figure 31A:
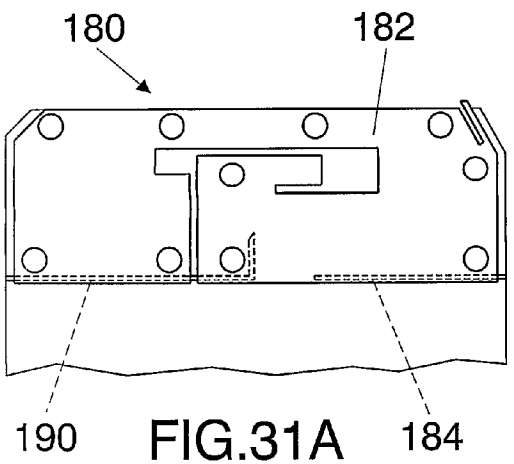

The invention also refers to an antenna system as shown for instance in FIGS. 20 to 23, which may comprises the ground plane (218) and the radiating element (142) previously described. The radiating element (142) is placed over the ground plane (218), and the radiating element has at least one edge (222) and the ground plane (218) has at least one slot. As shown for instance in FIG. 23*a*, at least a part of the edge (222) of the radiating element (142) is positioned over a part of one slot of the ground plane (218). More in detail, in the example of FIG. 23*a*, the entire edge (222) is positioned and extends over the whole length of the slots (148),(150) with the exception of the slot segment (223). With reference now to FIG. 31*c*, the slots (192),(194) are defined by substantially parallel slot edges (224),(225), and the edge (222) of the radiating element (142) is located over any position within the slot area delimited between said slot edges (224),(225) or it can be even positioned right over one of said edges.

The antenna system of the invention, as shown for instance in FIG. 23*a*, comprises a radiating element (142) provided with at least one hole (219) which defines a multilevel empty area on said radiating element (142). The shape of said empty area is formed by polygonal shapes connected or overlapping at a contact region of their perimeter, wherein the contact region between directly connected polygonal shapes is narrower than 50% of the perimeter of said polygonal shapes, and wherein the polygonal shapes have the same number of sides but not all the polygonal shapes have the same shape.

Preferably, the polygonal shapes are rectangles, and one of the polygonal shapes may be connected to the perimetric edge of the radiating element (142). In a preferred embodiment, the radiating element (142) is defined by substantially straight edges. The sides of the polygonal shapes may be substantially parallel to at least one side of the radiating element (142) as it can be seen for instance on FIG. 23*a*. Some of the corners (220) of the radiating element (142) may be cut off in order to facilitate its integration into a communication device. Furthermore, some attachment holes (221) may be provided on the radiating element (142) for its attachment to the dielectric mounting structure (146).

Further embodiments of the invention and particular combinations of features of the invention, are described in the attached claims.

This written description uses examples to disclose the invention, including the best mode, and also to enable a person skilled in the art to make and use the invention. The patentable scope of the invention may include other examples that occur to those skilled in the art. For example, multilevel ground-planes, as described herein, may be used in numerous antenna structures, such as mobile device antennas, base station antennas, car antennas, or other antennas that include a ground-plane.

The invention claimed is:

1. A mobile device, comprising:

a printed circuit board;

an antenna radiating element attached to a surface of the printed circuit board; and a multilevel ground plane integral with the printed circuit board and electromagnetically coupled to the antenna radiating element;

the multilevel ground plane comprising:

a first conducting surface;

a second conducting surface; and a conducting strip that couples the first conducting surface to the second conducting surface;

wherein at least a portion of the multilevel ground plane defines a space-filling curve;

wherein the antenna radiating element comprises at least one hole defining an empty area on the antenna radiating element;

wherein a shape of said empty area is formed by a plurality of polygonal shapes connected or overlapping at a contact region of a perimeter of said plurality of polygonal shapes;

wherein the contact region between directly connected polygonal shapes of the plurality of polygonal shapes is narrower than 50% of the perimeter of said directly connected polygonal shapes;

wherein the polygonal shapes of the plurality of polygonal shapes have the same number of sides but not all the polygonal shapes of the plurality of polygonal shapes have the same size;

wherein at least one edge of the antenna radiating element is aligned with a slot defined between the first conducting surface and the second conducting surface;

wherein an end of the slot is in contact with a perimetric edge of the multilevel ground plane; and wherein at least a part of the at least one hole is positioned over a part of the slot.

2. An antenna system, comprising:

a ground plane having a substantially rectangular shape;

a radiating element being placed over the ground plane;

the radiating element having at least one edge and the ground plane having a first slot and a second slot;

wherein the radiating element comprises at least one hole defining an empty area on the radiating element;

wherein a shape of said empty area is formed by a plurality of polygonal shapes connected or overlapping at a contact region of a perimeter of said plurality of polygonal shapes;

wherein the contact region between directly connected polygonal shapes of the plurality of polygonal shapes is narrower than 50% of the perimeter of said directly connected polygonal shapes;

wherein the polygonal shapes of the plurality of polygonal shapes have the same number of sides but not all the polygonal shapes of the plurality of polygonal shapes have the same size;

wherein the first slot has a first end that intersects a first edge of the ground plane and the second slot has a second end that intersect a second edge of the ground plane, wherein the second edge being opposite to the first edge;

wherein the first slot and the second slot are arranged in a projection area of the radiating element on the ground plane;

wherein the first slot and the second slot are not symmetrically arranged with respect to an axis parallel to a long dimension of the ground plane and dividing the ground plane into two substantially equal halves;

wherein at least a part of the at least one edge of the radiating element is aligned to and positioned over a part of at least one of the first slot and the second slot; and wherein at least a part of the at least one hole is positioned over a part of at least one of the first slot and the second slot.

3. The antenna system according to claim 2, wherein the first slot and the second slot are substantially parallel to an edge of the ground plane.

4. The antenna system according to claim 3, wherein one edge of the radiating element extends over the first slot and the second slot.

5. The antenna system according to claim 2, wherein the first slot, the second slot and the at least one edge of the radiating element placed over the first slot and the second slot are substantially straight.

6. The antenna system according to claim 2, wherein a part of at least one of the first slot and the second slot has a constant width, wherein said width is within the range from approximately 0.3 mm to approximately 3 mm.

7. The antenna system according to claim 2, wherein at least one slot of the first slot and the second slot has a slot segment at one of the ends of said at least one slot, wherein said slot segment defines an angle with respect to said slot.

8. The antenna system according to claim 7, wherein said slot segment is placed below the radiating element.

9. The antenna system according to claim 2, wherein at least a portion of the radiating element that operates within a determined band is positioned over a part of at least one of the first slot and the second slot.

10. The antenna system according to claim 2, further comprising a printed circuit board having at least one conducting layer, and wherein the radiating element is attached to the printed circuit board, and the ground plane is formed as one of said conducting layers and electromagnetically coupled to said radiating element.

11. The antenna system according to claim 10, wherein the ground plane is embedded within the printed circuit board and formed as an inner conducting layer of said printed circuit board.

12. The antenna system according to claim 10, wherein the printed circuit board is provided with said conducting layers on upper and lower faces of the printed circuit board, wherein the ground plane is formed as each of said conducting layers.

13. The antenna system according to claims 12, wherein the ground planes have the same shape.

14. The antenna system according to claim 2, wherein the first slot and the second slot define in the ground plane a first conducting surface, a second conducting surface, and a conducting strip that couples the first conducting surface to the second conducting surface.

15. The antenna system according to claim 14, wherein the width of the first and the second slot of at least one ground plane is greater than the width of the first and the second slot of the other ground planes.

16. The antenna system according to claim 15, wherein the width of the first and the second slot of at least one ground plane is greater than approximately 3 mm.

17. The antenna system according to claim 16, wherein the at least one ground plane comprising the first and the second slot, further comprises at least one via in the surface located between the first and the second slot to ground any other ground planes.

18. The antenna system according to claim 17, wherein at least one of a grounded pad and a grounded track comprised in the said printed circuit board is not placed over the first and the second slot.

19. The antenna system according to claim 14, wherein the conducting strip is shaped as at least one of a zigzag curve and a meandering curve.

20. The antenna system according to claim 2, wherein the polygonal shapes are rectangles.

21. The antenna system according to claim 2, wherein one of the polygonal shapes is connected to a perimetric edge of the radiating element.

22. The antenna system according to claim 2, wherein the radiating element is substantially rectangular.

23. The antenna system according to claim 2, wherein at least one of the corners of the radiating element is cut off in order to facilitate its integration into a communication device.

24. The antenna system according to claim 2, wherein at least one of the first slot and the second slot is at least in part shaped as a space-filling curve.

25. The antenna system according to claim 24, wherein said space-filling curve comprises at least ten connected segments, wherein said segments are smaller than a tenth of the operating free-space wave length and are spatially arranged in such a way that none of said adjacent and connected segments form another longer straight segment.

26. The antenna system according to claim 24, wherein said space-filling curve features a box-counting dimension larger than one.

27. The antenna system according to claim 2, wherein at least a portion of the geometry of said ground plane is a multilevel structure, said multilevel structure including a set of conducting polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons.

28. The antenna system according to claim 2, wherein the antenna is a multiband antenna.

29. A mobile communications device comprising:

an antenna system, the antenna system comprising:

a ground plane having a substantially rectangular shape;

a radiating element being placed over the ground plane;

the radiating element having at least one edge and the ground plane having a first slot and a second slot;

wherein the radiating element comprises at least one hole defining an empty area on the radiating element;

wherein a shape of said empty area is formed by a plurality of polygonal shapes connected or overlapping at a contact region of a perimeter of said plurality of polygonal shapes;

wherein the contact region between directly connected polygonal shapes of the plurality of polygonal shapes is narrower than 50% of the perimeter of said directly connected polygonal shapes;

wherein the polygonal shapes of the plurality of polygonal shapes have the same number of sides but not all the polygonal shapes of the plurality of polygonal shapes have the same size;

wherein the first slot has a first end that intersects a first edge of the ground plane and the second slot has a second end that intersect a second edge of the ground plane, wherein the second edge being opposite to the first edge;

wherein the first slot and the second slot are arranged in a projection area of the radiating element on the ground plane;

wherein the first slot and the second slot are not symmetrically arranged with respect to an axis parallel to a long dimension of the ground plane and dividing the ground plane into two substantially equal halves;

wherein at least a part of the at least one edge of the radiating element is aligned to and positioned over a part of at least one of the first slot and the second slot; and wherein at least a part of the at least one hole is positioned over a part of at least one of the first slot and the second slot.

30. The mobile communications device according to claim 29, wherein the antenna system conserves space inside the said mobile communication device enabling at least one component to be mounted on the printed circuit board opposite to the antenna structure.

31. The mobile communications device according to claim 30, wherein the at least one component comprises at least one of a speaker and a vibration mechanism.

32. The mobile communication device according to claim 29, wherein the mobile communication device is selected from the group consisting of: a cellular telephone, a PDA, and a pager.

33. The mobile communications device according to claim 29, wherein the mobile communications device operates in at least one typical cellular frequency band between approximately 800 MHz and approximately 3000 MHz.

* * * * *